US010042329B2

(12) United States Patent
Akiyama

(10) Patent No.: US 10,042,329 B2
(45) Date of Patent: Aug. 7, 2018

(54) ELECTRONIC DEVICE, TIME CORRECTION METHOD, AND TIME CORRECTION PROGRAM

(71) Applicant: Seiko Epson Corporation, Tokyo (JP)

(72) Inventor: Toshikazu Akiyama, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/459,533

(22) Filed: Mar. 15, 2017

(65) Prior Publication Data

US 2017/0277140 A1 Sep. 28, 2017

(30) Foreign Application Priority Data

Mar. 22, 2016 (JP) ..... 2016-057312

(51) Int. Cl.

| | |
|---|---|
| ***G04B 19/04*** | (2006.01) |
| ***G04R 20/02*** | (2013.01) |
| ***G04B 19/24*** | (2006.01) |

(52) U.S. Cl.

CPC ..... *G04R 20/02* (2013.01); *G04B 19/048* (2013.01); *G04B 19/241* (2013.01)

(58) Field of Classification Search

CPC ..... G04B 19/241; G04B 19/24; G04B 19/04; G04B 19/048; G04R 20/02; G04R 20/04; G04R 20/06

See application file for complete search history.

(56) References Cited

U.S. PATENT DOCUMENTS

| | | | | |
|---|---|---|---|---|
| 8,792,308 | B2 * | 7/2014 | Kato | G04R 20/06 368/47 |
| 9,448,541 | B2 * | 9/2016 | Akiyama | G04R 20/04 |
| 9,448,542 | B2 * | 9/2016 | Honda | G04R 20/04 |
| 9,483,029 | B2 * | 11/2016 | Iida | G04G 9/00 |
| 2003/0151984 | A1 | 8/2003 | Speichinger et al. | |
| 2005/0185516 | A1 | 8/2005 | Lazaretnik | |
| 2011/0280108 | A1 | 11/2011 | Honda | |
| 2012/0201103 | A1 | 8/2012 | Bakker | |

(Continued)

FOREIGN PATENT DOCUMENTS

| | | |
|---|---|---|
| EP | 2 555 061 A1 | 2/2013 |
| JP | 2000-131469 A | 5/2000 |

(Continued)

OTHER PUBLICATIONS

Extended European Search Report for Application No. EP 17 16 1787 dated Jul. 6, 2017 (6 pages).

*Primary Examiner* — Sean Kayes
(74) *Attorney, Agent, or Firm* — Harness, Dickey & Pierce, P.L.C.

(57) ABSTRACT

An electronic timepiece enables displaying multiple times and easily correcting the displayed time. An electronic device has a correction mode setting unit that sets a first time correction mode for adjusting a first time, or a second time correction mode for adjusting a second time, in response to a correction mode setting operation; and a display control unit that moves an indicator hand to a first indicated position indicating that the hands to be corrected are first hands when the first time correction mode is set, and moves the indicator hand to the second indicated position indicating that the hands to be corrected are second hands when the second time correction mode is set.

24 Claims, 23 Drawing Sheets

(56) References Cited

U.S. PATENT DOCUMENTS

| | | | | |
|---|---|---|---|---|
| 2015/0253740 | A1 | 9/2015 | Nishijima et al. | |
| 2015/0268638 | A1* | 9/2015 | Hasegawa | G04R 20/04 368/47 |
| 2015/0286190 | A1* | 10/2015 | Honda | G04R 20/04 368/47 |
| 2016/0048109 | A1* | 2/2016 | Honda | G04R 20/04 368/47 |
| 2016/0161924 | A1* | 6/2016 | Fujisawa | G04G 5/002 368/47 |
| 2016/0209813 | A1* | 7/2016 | Hasegawa | G04R 20/02 |
| 2016/0266548 | A1 | 9/2016 | Akiyama | |
| 2016/0266553 | A1* | 9/2016 | Hasegawa | G04G 9/0076 |

FOREIGN PATENT DOCUMENTS

| | | | |
|---|---|---|---|
| JP | 2008-261683 | A | 10/2008 |
| JP | 2009-008504 | A | 1/2009 |
| JP | 2011-237314 | A | 11/2011 |
| JP | 2014-182047 | A | 9/2014 |
| JP | 2014-215147 | A | 11/2014 |
| JP | 2015-055478 | A | 3/2015 |
| JP | 2015-169500 | A | 9/2015 |
| JP | 2016-166786 | A | 9/2016 |

* cited by examiner

ELECTRONIC DEVICE, TIME CORRECTION METHOD, AND TIME CORRECTION PROGRAM

BACKGROUND

1. Technical Field

The present invention relates to an electronic device, a time correction method, and a time correction program.

2. Related Art

Electronic timepieces that have two sets of hour and minute hands for displaying two different times are known from the literature. See, for example, JP-A-2009-8504.

The electronic timepiece described in JP-A-2009-8504 has first hands including a first minute hand and a first hour hand disposed to a pivot in the center of the dial, and second hands including a second minute hand and a second hour hand disposed to a pivot located at a position offset toward 6:00 from the center of the dial. When the crown is pulled out to the first stop, this electronic timepiece goes to a first hands correction mode for correcting the positions of the first hands, and goes to a second hands correction mode for correcting the positions of the second hands when the crown is pulled out to the second stop.

However, if the user does not remember the relationship between the stop position of the crown and the time correction mode when pulling the crown out to adjust the first hands or the second hands of the electronic timepiece described in JP-A-2009-8504, determining whether the first hands correction mode or the second hands correction mode is selected is not easy. Correcting the desired display time is therefore difficult.

SUMMARY

An electronic timepiece, a time correction method, and a time correction program according to the invention can display multiple times and enable setting the time easily.

An electronic device according one aspect of the invention has first hands including a first hour hand and a first minute hand for displaying a first time; second hands including a second hour hand and a second minute hand for displaying a second time, and disposed to a pivot at a different location than the pivot of the first hands; an indicator hand on a pivot at a different location than the pivots of the first hands and the second hands; an operating unit; a correction mode setting unit that sets a first time correction mode for adjusting the first time, or a second time correction mode for adjusting the second time, in response to a correction mode setting operation; and a display control unit configured to move the indicator hand to the first indicated position indicating that the hands to be corrected are the first hands when the first time correction mode is set, and move the indicator hand to the second indicated position indicating that the hands to be corrected are the second hands when the second time correction mode is set.

When the user performs the correction mode setting operation on the operating unit, the correction mode setting unit sets the first time correction mode or the second time correction mode. When the first time correction mode is set, the display control unit sets the indicator hand to the first indicated position indicating that the hands to be corrected are the first hands; and when the second time correction mode is set, sets the indicator hand to the second indicated position indicating that the hands to be corrected are the second hands.

As a result, by looking at the indicator hand, the user can intuitively know whether the first time correction mode is set or the second time correction mode is set, and can easily adjust the time.

An electronic device according to another aspect of the invention has first hands including a first hour hand and a first minute hand for displaying a first time; second hands including a second hour hand and a second minute hand for displaying a second time, and disposed to a pivot at a different location than the pivot of the first hands; an indicator hand disposed to a pivot at a different location than the pivots of the first hands and the second hands; an operating unit; a correction mode setting unit configured to set a first time correction mode for adjusting the first time in response to an enable correction mode operation of the operating unit causing entering a time correction mode, or switch to the first time correction mode or a second time correction mode for correcting the second time in response to a change correction mode operation of the operating unit causing changing the type of the time correction mode; and a display control unit configured to, when the first time correction mode is set in response to the enable correction mode operation, not point the indicator hand to the first indicated position, which indicates the hands to be corrected are the first hands, when the first time correction mode is set in response to the change correction mode operation, point the indicator hand to the first indicated position, and when the second time correction mode is set, point the indicator hand to a second indicated position, which indicates the hands to be corrected are the second hands.

When the user performs the enable correction mode operation on the operating unit, the correction mode setting unit in this aspect of the invention changes the normal time display mode to the first time correction mode, for example. When the user performs the change correction mode operation on the operating unit, the correction mode setting unit sets the second time correction mode, and when the user again performs the change correction mode operation on the operating unit, the correction mode setting unit sets the first time correction mode.

If the user already knows that the first time correction mode is set when the enable correction mode operation is performed, the user can know that the first time correction mode is set when the enable correction mode operation is performed even if the indicator hand does not point to the first indicated position.

As a result, by not indicating the first indicated position with the indicator hand when the first time correction mode is set by the enable correction mode operation, the user can quickly adjust the first time without waiting for the indicator hand to move after performing the enable correction mode operation.

By setting the indicator hand to the first indicated position or the second indicated position when the second time correction mode or first time correction mode is set by the change correction mode operation after the enable correction mode operation, the user can intuitively understand whether the first time correction mode is set or the second time correction mode is set by looking at the indicator hand.

Preferably, as the first indicated position, the display control unit points the indicator hand to the position of the pivot of the first hands in the direction indicated by the indicator hand; as the second indicated position, points the indicator hand to the position of the pivot of the second hands in the direction indicated by the indicator hand.

This configuration clearly indicates whether the hands to be corrected are the first hands or the second hands.

Further preferably, the pivot of the indicator hand is located outside of a circle drawn by the distal end of at least one of the first hands and the second hands; and the display control unit, as the indicated position indicating the hands to be corrected are one of the first hands or second hands, points the indicator hand to a specific position within the arc of intersection between said circle and a line extending in the indication direction of the indicator hand.

This configuration can indicate that the hands to be corrected are one of the hands.

If the pivot of the indicator hand is outside a circle (other circle) drawn by the distal end of another hand, for example, the display control unit points the indicator hand to a specific position within the range of intersection between a line extending in the direction indicated by the indicator hand and said other circle as the indicated position showing that the hands to be corrected are the other hands. If the pivot of the indicator hand is inside the other circle, the indicator hand points to an indicated position where the pivot of the other hand is located in the direction indicated by the indicator hand.

In an electronic device according to another aspect of the invention, if a previously set display time has passed after pointing the indicator hand to the first indicated position or the second indicated position, the display control unit points the indicator hand to a position other than the first indicated position or second indicated position to indicate specific information.

The specific information is the daylight saving time setting, for example.

After the indicator hand points to the first indicated position or second indicated position, the user can know specific information by checking the position of the indicator hand after a specific display (indication) time passes.

As a result, because there is no need to provide a separate hand to indicate the specific information, the number of hands on the electronic device can be reduced.

Furthermore, after the indicator hand points to the first indicated position or second indicated position, the user can know specific information without operating the operating unit, and operation can be simplified.

In an electronic device according to another aspect of the invention, when the indicator hand is set to the first indicated position or the second indicated position, the display control unit points the indicator hand to a position other than the first indicated position or second indicated position to indicate specific information in response to operation of the operating unit.

After the indicator hand points to the first indicated position or second indicated position, the user can get specific information by manipulating the operating unit and checking the position to which the indicator hand moved.

As a result, because there is no need to provide a separate hand to indicate the specific information, the number of hands on the electronic device can be reduced.

In an electronic device according to another aspect of the invention, the specific information is a daylight saving time setting.

When the user changes the first time or second time to the time of a different region, the user may also want to know the daylight saving time setting in that time zone. This configuration enables the user to check the daylight saving time setting by reading the indicator hand that moves after the first indicated position or second indicated position is indicated. As a result, if correcting the time zone setting is required, the user can change the DST setting by manipulating the operating unit, and ease of use is improved.

An electronic device according to another aspect of the invention preferably also has a time zone setting unit configured to, when the first time correction mode is set, correct the time zone setting of the first time in response to a time zone correction operation of the operating unit, and when the second time correction mode is set, correct the time zone setting of the second time in response to a time zone correction operation of the operating unit; and a time correction unit configured to correct the first time based on the corrected time zone setting of the first time, and correct the second time based on the corrected time zone setting of the second time.

When the user changes the first time or second time to the time of a different region, the user can also change the first time or second time in conjunction therewith by performing the time zone correction operation. Operation is therefore simplified compared with needing to manually operate the operating unit to set the first time or second time to the time of the other region.

An electronic device according to another aspect of the invention preferably also has a time zone hand that displays time zone data; the display control unit pointing the time zone hand to indicate the time zone of the first time when the first time correction mode is set, and pointing the time zone hand to indicate the time zone of the second time when the second time correction mode is set.

The time zone hand may be the hand used to indicate the second of the first time and second time when time zone data is not indicated, or a specific other hand may be used to indicate the time zone.

In this configuration, the user can know the time zone of the first time by reading the time zone hand when the first time correction mode is set in this configuration, can know the time zone of the second time by reading the time zone hand by reading the time zone hand when the second time correction mode is set, and can easily determine whether or not changing the time zone setting is required.

In an electronic device according to another aspect of the invention, the display control unit preferably moves the indicator hand and the time zone hand simultaneously when the first time correction mode or the second time correction mode is set and the indicator hand and the time zone hand are moved.

Moving the indicator hand and the time zone hand simultaneously means that the time during which the indicator hand moves and the time during which the time zone hand moves overlap.

This configuration can shorten the time until movement of both the indicator hand and the time zone hand stop moving compared with when the time during which the indicator hand moves and the time during which the time zone hand moves do not overlap.

In an electronic device according to another aspect of the invention, when moving the indicator hand and the time zone hand when the first time correction mode or the second time correction mode is set, the display control unit moves the indicator hand, then moves the time zone hand after moving the indicator hand, and after moving the time zone hand, points the indicator hand to a position other than the first indicated position and second indicated position to display specific information.

In this configuration the time during which the indicator hand moves and the time during which the time zone hand moves do not overlap. Peak power consumption is therefore lower than in a configuration in which the time during which the indicator hand moves and the time during which the time zone hand moves overlap.

Because the time zone hand can indicate the time zones of both the first time and the second time, the user cannot correctly know which time zone is indicated without knowing whether the time zone indicated by the time zone hand is the time zone of the first time or the second time.

Therefore, by moving the indicator hand before the time zone hand, the user can know which time zone is indicated more quickly than if the indicator hand is moved after the time zone hand.

The user can also get specific information by reading the indicator hand, which moves again after the time zone hand moves.

An electronic device according to another aspect of the invention preferably also has a dial; and the pivots of the first hands and the time zone hand are in the plane center of the dial.

This configuration can increase the length of the first hands and the time zone hand compared with a configuration in which the pivots of the first hands and the time zone hand are offset to the outside from the plane center of the dial. As a result, the first time and time zone data can be displayed with a dynamic movement.

Note that the pivot of the second hands is offset to the outside circumference from the center of the dial.

In an electronic device according to another aspect of the invention, the display control unit continuously moves the first hour hand, the first minute hand, the second hour hand, and the second minute hand when the first time correction mode or the second time correction mode is set.

To set the first time or second time to the time of a different region, the user of this configuration can correct the first time or second time with reference to the current time by checking the first hands or second hands after setting the first time correction mode or second time correction mode.

Another aspect of the invention is a time correction method of an electronic device including a first hour hand and a first minute hand for displaying a first time, second hands including a second hour hand and a second minute hand for displaying a second time, and disposed to a pivot at a different location than the pivot of the first hands, an indicator hand disposed to a pivot at a different location than the pivots of the first hands and the second hands; and an operating unit, the time correction method comprising steps of: setting a first time correction mode for adjusting the first time, or a second time correction mode for adjusting the second time, in response to a correction mode setting operation of the operating unit; setting the indicator hand to the first indicated position indicating that the hands to be corrected are the first hands when the first time correction mode is set; and setting the indicator hand to the second indicated position indicating that the hands to be corrected are the second hands when the second time correction mode is set.

With this configuration, by looking at the indicator hand, the user can intuitively know whether the first time correction mode is set or the second time correction mode is set, and can easily adjust the time.

Another aspect of the invention is a time correction method of an electronic device having first hands including a first hour hand and a first minute hand for displaying a first time, second hands including a second hour hand and a second minute hand for displaying a second time, and disposed to a pivot at a different location than the pivot of the first hands, an indicator hand disposed to a pivot at a different location than the pivots of the first hands and the second hands, and an operating unit, the time correction method comprising steps of: setting a first time correction mode for adjusting the first time in response to an enable correction mode operation of the operating unit causing entering a time correction mode; switching to the first time correction mode or a second time correction mode for correcting the second time in response to a change correction mode operation of the operating unit causing changing the type of the time correction mode; when the first time correction mode is set in response to the enable correction mode operation, not pointing the indicator hand to the first indicated position, which indicates the hands to be corrected are the first hands; when the first time correction mode is set in response to the change correction mode operation, pointing the indicator hand to the first indicated position; and when the second time correction mode is set, pointing the indicator hand to a second indicated position, which indicates the hands to be corrected are the second hands.

This configuration enables the user to quickly adjust the first time without waiting for the indicator hand to move after performing the enable correction mode operation. In addition, if the change correction mode operation is performed after the enable correction mode operation, the user can intuitively know if the first time correction mode is set or the second time correction mode is set by reading the indicator hand.

Another aspect of the invention is a time correction program causing an electronic device having first hands including a first hour hand and a first minute hand for displaying a first time, second hands including a second hour hand and a second minute hand for displaying a second time, and disposed to a pivot at a different location than the pivot of the first hands, an indicator hand disposed to a pivot at a different location than the pivots of the first hands and the second hands; and an operating unit, to execute steps comprising: setting a first time correction mode for adjusting the first time, or a second time correction mode for adjusting the second time, in response to a correction mode setting operation of the operating unit; setting the indicator hand to the first indicated position indicating that the hands to be corrected are the first hands when the first time correction mode is set; and setting the indicator hand to the second indicated position indicating that the hands to be corrected are the second hands when the second time correction mode is set.

With this configuration, by looking at the indicator hand, the user can intuitively know whether the first time correction mode is set or the second time correction mode is set, and can easily adjust the time.

Another aspect of the invention is a time correction program causing an electronic device having first hands including a first hour hand and a first minute hand for displaying a first time, second hands including a second hour hand and a second minute hand for displaying a second time, and disposed to a pivot at a different location than the pivot of the first hands, an indicator hand disposed to a pivot at a different location than the pivots of the first hands and the second hands; and an operating unit, to execute steps comprising: setting a first time correction mode for adjusting the first time in response to an enable correction mode operation of the operating unit causing entering a time correction mode; switching to the first time correction mode or a second time correction mode for correcting the second time in response to a change correction mode operation of the operating unit causing changing the type of the time correction mode; when the first time correction mode is set in response to the enable correction mode operation, not pointing the indicator hand to the first indicated position, which indicates the hands to be corrected are the first hands; when the first time correction mode is set in response to the change correction mode operation, pointing the indicator hand to the first indicated position; and when the second time correction mode is set, pointing the indicator hand to a second indicated position, which indicates the hands to be corrected are the second hands.

This configuration enables the user to quickly correct the first time without waiting for the indicator hand to move after performing the enable correction mode operation. If the change correction mode operation is performed after the enable correction mode operation, the user can also know by reading the indicator hand if the first time correction mode is set or the second time correction mode is set.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the present invention are described below with reference to the accompanying figures.

Embodiment 1

Figure 1:
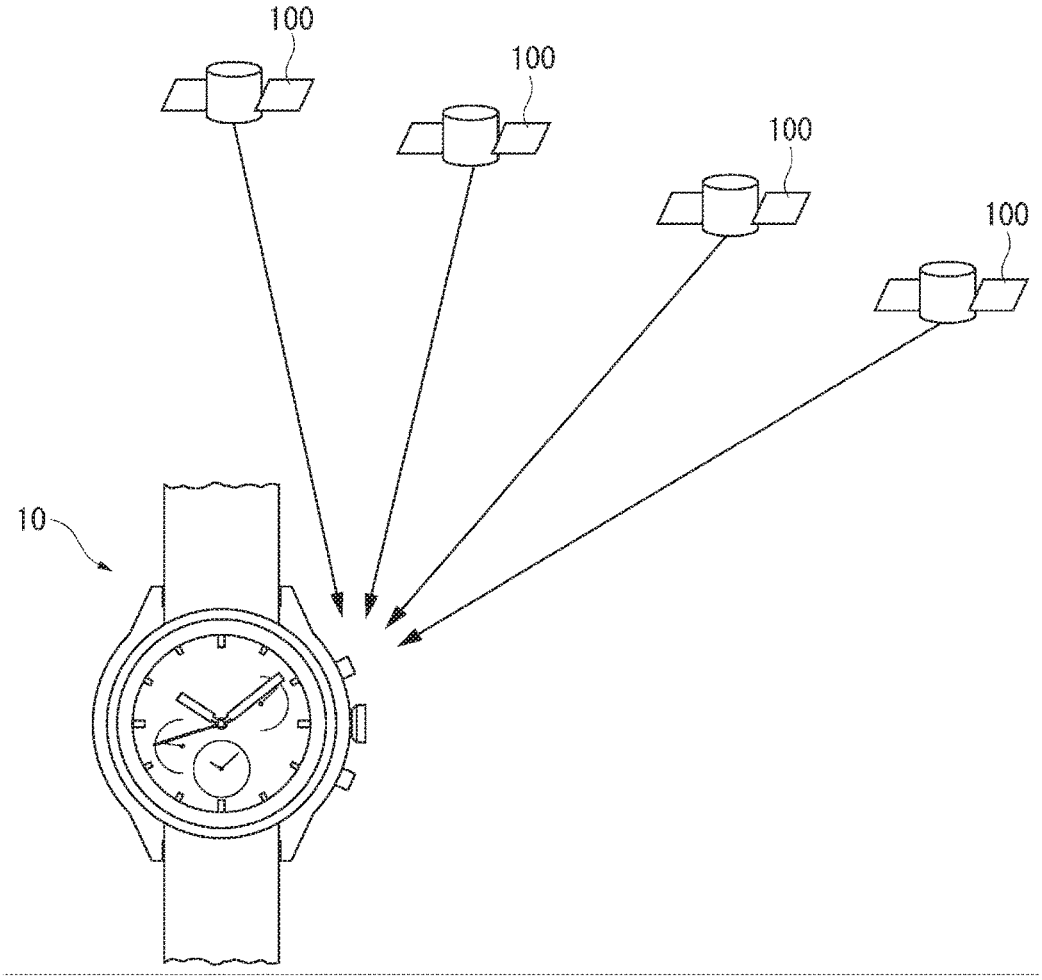
FIG. 1 schematically illustrates use of an electronic timepiece according to a first embodiment of the invention.

FIG. 1 illustrates the use of an electronic timepiece 10 according to the first embodiment of the invention.

The electronic timepiece 1 described as an example of an electronic device according to the invention receives satellite signals from at least one of the multiple positioning information satellites 100 orbiting the Earth on known orbits to acquire time information, and receives satellite signals from at least three of the positioning information satellites 100 to calculate positioning information. A GPS satellite 100 is an example of a positioning information satellite, and there are currently approximately 30 GPS satellites 100 in service.

Electronic Timepiece Construction

The electronic timepiece 10 in this embodiment of the invention is a timepiece that has a dual time display function for displaying a first time and a second time.

Figure 2:
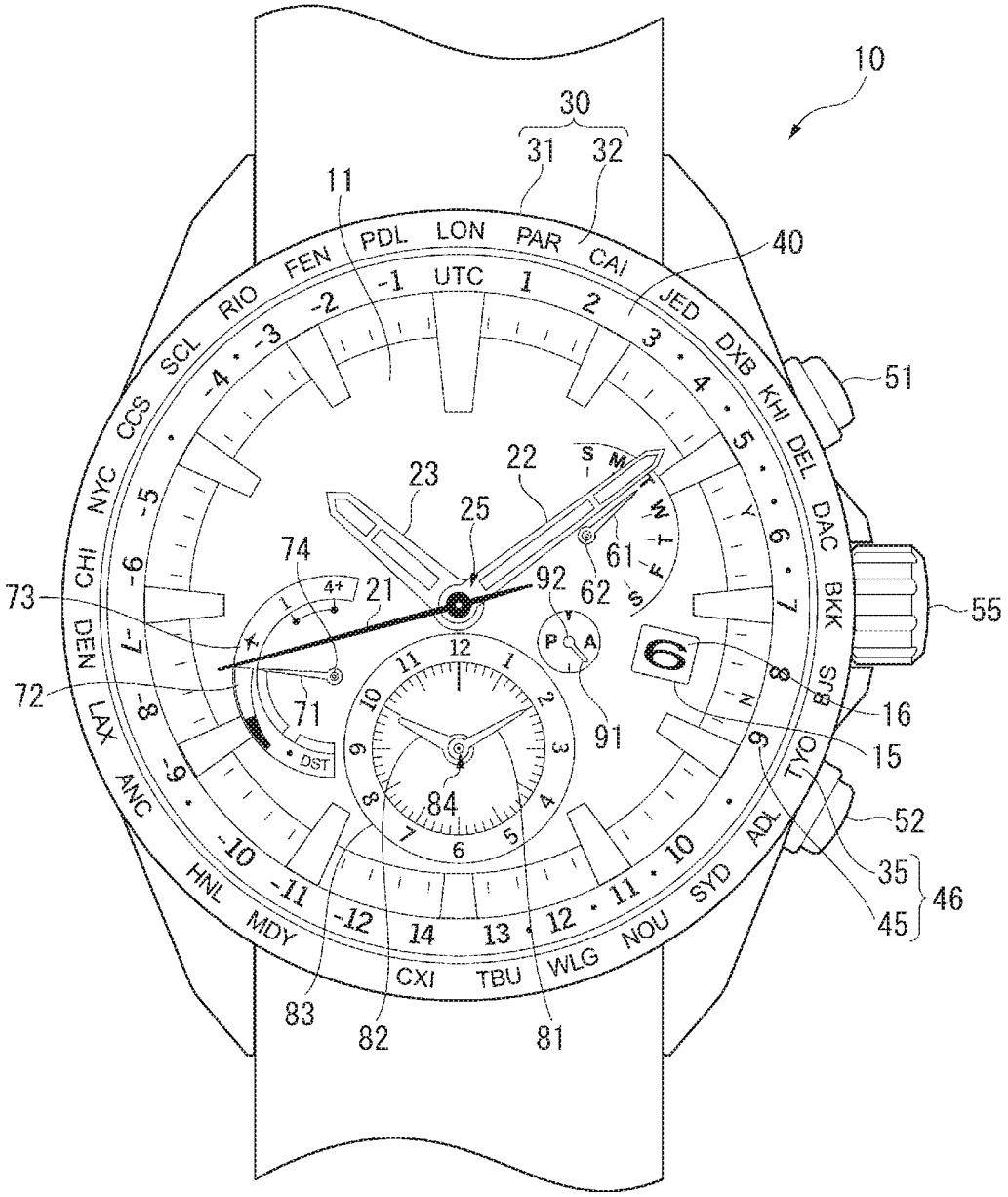
FIG. 2 is a front view of an electronic timepiece according to the first embodiment of the invention.
Figure 3:
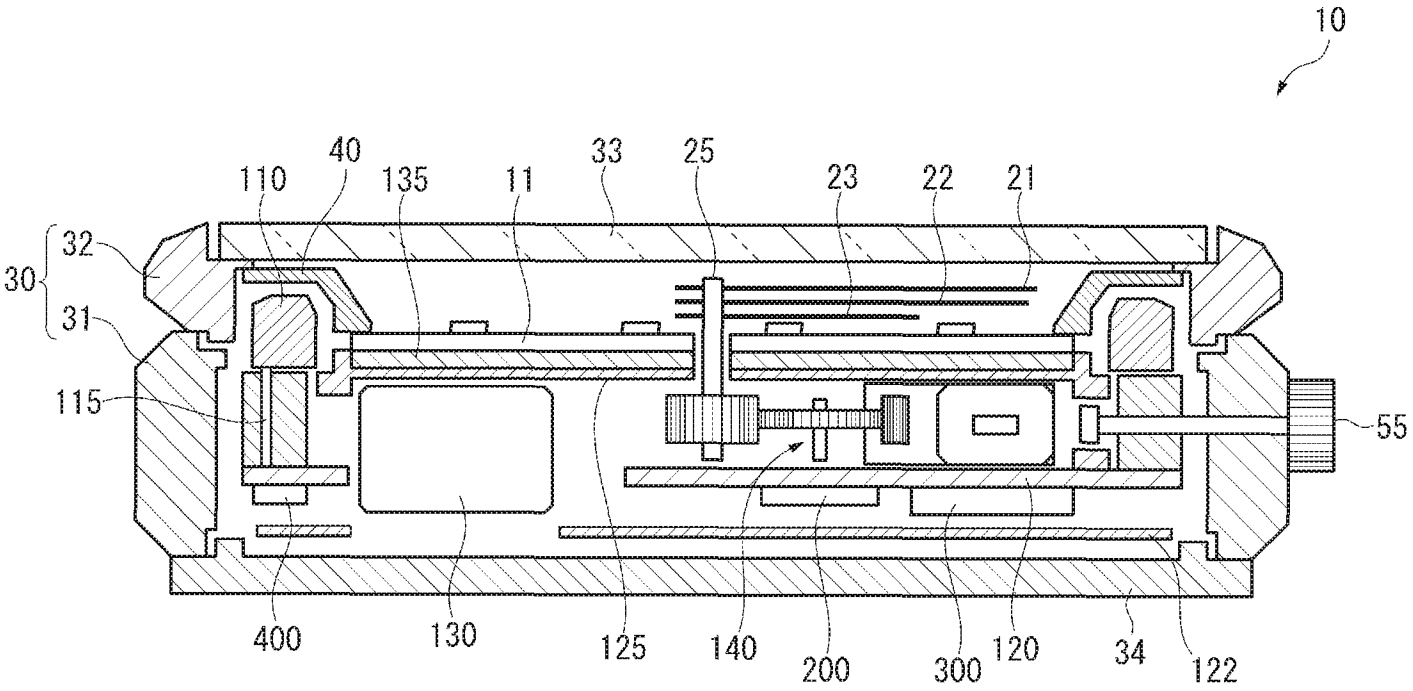
FIG. 3 is a section view of a electronic timepiece according to the first embodiment of the invention.

FIG. 2 is a front view of the electronic timepiece 10, and FIG. 3 is a basic section view of the electronic timepiece 10.

As shown in FIG. 2 and FIG. 3, the electronic timepiece 10 has an external case 30, crystal 33, and back cover 34.

The external case 30 includes a ceramic bezel 32 affixed to a cylindrical case member 31 made of metal. A round dial 11 used as the time display unit is held inside the inside circumference of the bezel 32 by means of a plastic dial ring 40.

Disposed around the center of the dial 11 in the side of the external case 30 are a button A 51 at 2:00, a button B 52 at 4:00, and a crown 55 at 3:00.

As shown in FIG. 3, of the two main openings in the external case 30, the opening on the face side is covered by the crystal 33 held by the bezel 32, and the opening on the back is covered by the metal back cover 34.

Inside the external case 30 are the dial ring 40 attached to the inside circumference of the bezel 32; an optically transparent dial 11; hands 21, 22, 23, 61, 71, 81, 82, 91, a calendar wheel 16, and a drive mechanism 140 that drives the hands and the calendar wheel 16.

The dial ring 40 has a flat portion around the outside that contacts the inside circumference surface of the bezel 32 and is parallel to the crystal 33, and a beveled portion that slopes from the inside circumference part of the flat portion down to the dial 11 and contacts the dial 11. The dial ring 40 is shaped like a ring when seen in plan view, and is conically shaped when seen in section. The flat part and beveled part of the dial ring 40, and the inside circumference surface of the bezel 32, create a donut-shaped space inside of which a ring-shaped antenna 110 is housed.

The dial 11 is a round disk for indicating the time inside the external case 30, is made of plastic or other light-transparent material, and is disposed inside of the dial ring 40 with the hands between the dial 11 and the crystal 33.

A solar panel 135, which is a photovoltaic power generator, is disposed between the dial 11 and a main plate 125 to which the drive mechanism 140 is disposed. The solar panel 135 is a round flat panel having plural solar cells (photovoltaic devices) that convert light energy to electrical energy (power) connected in series. Through-holes through which the center pivot 25 of the hands 21, 22, 23, the pivot 62 of the hand 61, the pivot 74 of hand 71, the pivot 84 of the hands 81, 82, and the pivot 92 of hand 91 pass are formed in the dial 11, solar panel 135, and main plate 125. An aperture for the calendar window 15 is also formed in the dial 11 and solar panel 135.

The drive mechanism 140 is disposed to the main plate 125, and is covered by a circuit board 120 from the back side. The drive mechanism 140 includes a stepper motor and wheel train, and drives the hands by the stepper motor rotationally driving the pivots and such through the wheel train.

The drive mechanism 140 more specifically includes first to sixth drive mechanisms. The first drive mechanism drives the minute hand 22 (first minute hand) and hour hand 23 (first hour hand); the second drive mechanism drives the second (time zone) hand 21; the third drive mechanism drives hand 61; the fourth drive mechanism drives hand 71; the fifth drive mechanism drives hands 81, 82, and 91; and the sixth drive mechanism drives the calendar wheel 16.

The circuit board 120 has a reception device (GPS module) 400, a control device 300, and a storage device 200. The circuit board 120 and antenna 110 connect through an antenna connection pin 115. A circuit cover 122 covers the reception device 400, control device 300, and storage device 200 from the back cover 34 side of the circuit board 120 to which these parts are disposed. A lithium ion battery or other type of storage battery 130 is disposed between the ground plate 125 and the back cover 34. The storage battery 130 is charged with power produced by the solar panel 135.

Display Mechanism of the Electronic Timepiece

The second (time zone) hand 21, first minute hand 22, and first hour hand 23 are disposed to a center pivot 25 that passes through the plane center of the dial 11 and is aligned with the center axis between the front and back of the timepiece. Note that the center pivot 25 comprises three pivots to which the hands 21, 22, 23 are attached.

As shown in FIG. 2, a scale of 60 minute markers is formed on the inside circumference side of the dial ring 40 around the outside edge of the dial 11. When normally displaying the time, the second of the first time (local time, such as the current local time when travelling abroad) is indicated by the second (time zone) hand 21, the minute of the first time is indicated by the first minute hand 22, and the hour of the first time is indicated by the first hour hand 23 using these markers. Note that because the second of the first time is the same as the second of the second time described below, the user can also know the second of the second time by reading the second hand 21.

Note that the minute hand 22 and hour hand 23 are examples of the first hands of the invention.

Note that the letter Y is disposed at the 12 minute marker on the dial ring 40, and the letter N is disposed at the 18 minute marker. These letters denote the result of receiving (acquiring) information based on the satellite signals from the GPS satellites 100, Y meaning that reception (acquisition) was successful, and N meaning that reception (acquisition) failed. The second hand 21 points to either Y or N to indicate the result of satellite signal reception.

A hand 61 (day hand) is attached to a pivot 62 at a position offset from the center of the dial 11 near 2:00. The letters S, M, T, W, T, F, S denoting the seven days of the week are disposed in an arc around the axis of rotation of the hand 61. The hand 61 points to one of the letters S, M, T, W, T, F, S to indicate the day of the week as calendar information for the first time.

Another hand 71 (mode indicator) is disposed to a pivot 74 offset from the center of the dial 11 near 8:00. The markers around the outside of the axis of rotation of the hand 71 are described below, but it should be noted that referring to hand 71 pointing in the direction of n:00 (where n is a natural number) below means the position of that time on an imaginary clock dial centered on the pivot 74 of the hand 71.

DST and a black dot are disposed in the area between 6:00 and 7:00 on the imaginary dial around the hand 71. DST denotes daylight saving time. The hand 71 points to either DST or the dot depending on whether or not the electronic timepiece 10 is set to the DST mode (DST meaning the daylight saving time mode is on, and the black dot meaning the DST mode is off).

A sickle-shaped symbol 72 that is wide at the 9:00 end and narrows to the 8:00 end is formed in the area from 8:00 to 9:00 along the outside of the range of hand 71 rotation. This symbol 72 is used as a reserve power indicator for the storage battery 130 (FIG. 3), and the power reserve is indicated by the hand 71 pointing to the position appropriate to the reserve power in the battery. Note that this hand 71 normally points to a position in the symbol 72.

An airplane symbol 73 is provided at 10:00 on the hand 71 dial. This symbol is used to indicate the airplane mode. Receiving satellite signals is prohibited by law when a commercial plane is taking off and landing. By pointing to the airplane symbol 73, the hand 71 indicates the airplane mode is set and satellite signals will not be received.

The number 1 and symbol 4+ are at 11:00 and 12:00 on the imaginary dial of the hand 71. These symbols are used in the satellite signal reception mode. The hand 71 points to 1 when GPS time information is received and the internal time adjusted (in the timekeeping mode), and points to 4+ when receiving GPS time information and orbit information, calculating the positioning information indicating the current location, and correcting the internal time and time zone (in the positioning mode) as described below.

Hand 71 can also point to the pivot 84 of the hands 81, 82. More specifically, hand 71 is another example of an indicator. Operation of the hand 71 is described in detail in the description of the time zone setting process below.

Hand 81 (second minute hand) and hand 82 (second hour hand) are attached to concentric pivots 84 in a small dial offset toward 6:00 from the center of the dial 11. Note that this pivot 84 comprises two concentric pivots to which the hands 81, 82 are attached. The large hand 81 indicates the minute of the second time (home time, in this example, the time in Japan when travelling in a different country), and the other hand 82 indicates the hour of the second time. Hands 81, 82 are an example of the second hands (second indicator) in this embodiment.

A subdial 83 is formed in a ring around the rotational range of the hands 81, 82. The subdial 83 has the numeric markers 1 to 12 representing the hour of the second time.

Hand 91 is disposed to a pivot 92 at a position offset toward 4:00 from the center of the dial 11, and indicates whether the second time is ante meridiem (a.m.) or post meridiem (p.m.).

The calendar window 15 is a small rectangular opening in the dial 11 through which a number printed on the calendar wheel 16 can be seen. The calendar wheel 16 shows the day value of the current date at the first time by rotating so that the appropriate number can be seen in the calendar window 15.

Time difference information 45 indicating the time difference to UTC (Coordinated Universal Time) is denoted by numbers and non-numeric symbols around the inside circumference of the dial ring 40. Numeric time difference information 45 denotes the time difference in integer values, and symbolic time difference information 45 indicates the time difference when the time difference is not an integer value. The time difference between the first time indicated by hands 21, 22, 23 and UTC can be checked in the time correction mode described below by reading the time difference information 45 pointed to by the second hand 21. In other words, the second hand 21 is also used as a time zone hand for indicating time zone information.

City name information 35 is disposed beside the time difference information 45 on the bezel 32 surrounding the dial ring 40. The city name information 35 denotes the name of a city located in the time zone that uses the standard time corresponding to the time difference indicated by the time difference information 45 on the dial ring 40. The markers of the time difference information 45 and the city name information 35 embody a time zone display 46. The time zone display 46 in this embodiment of the invention has the same number of time zone markers as there are time zones used in the world today.

Internal Configuration of Electronic Timepiece

Figure 4:
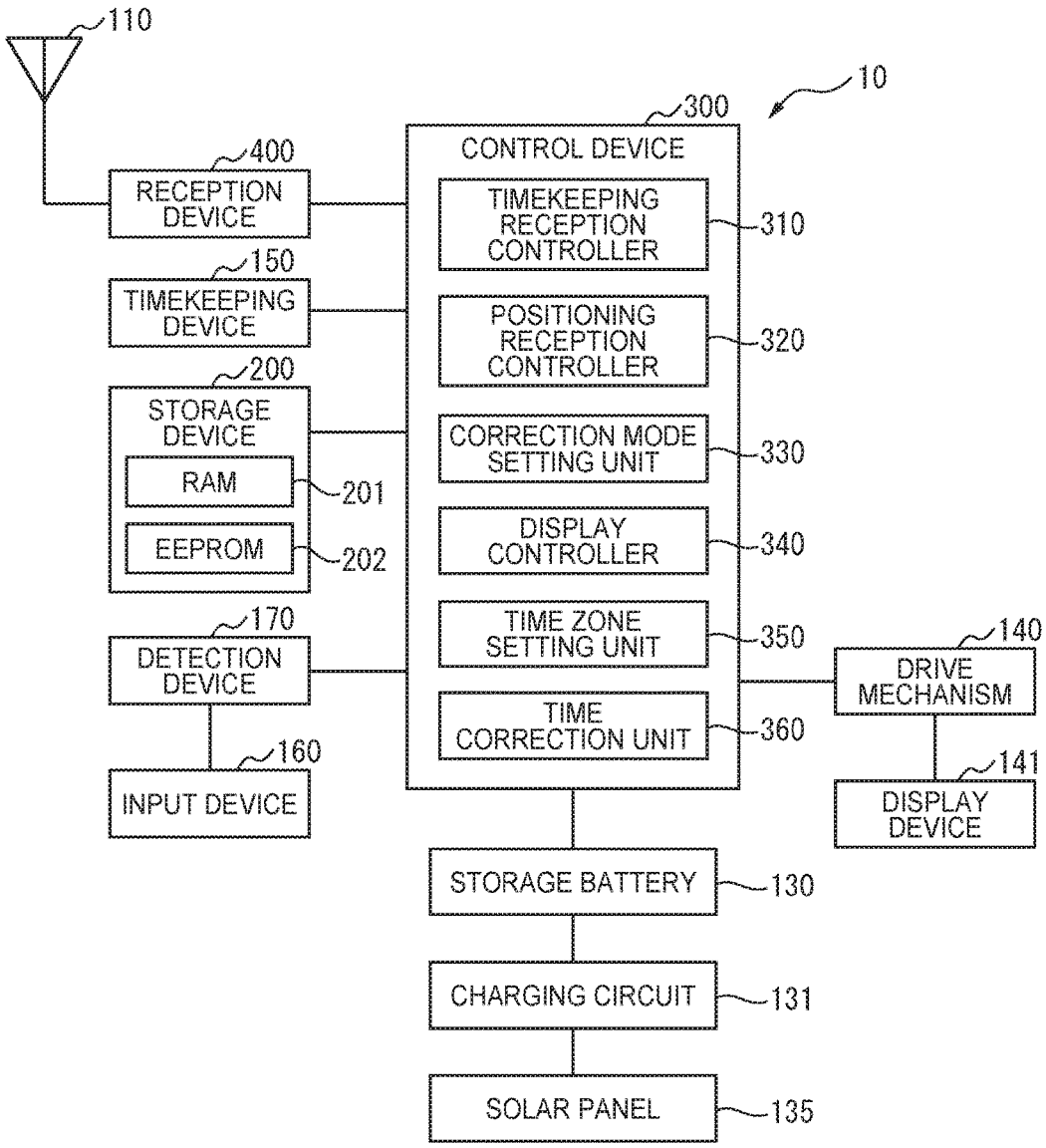
FIG. 4 is a control block diagram of an electronic timepiece according to the first embodiment of the invention.

FIG. 4 is a control block diagram of the electronic timepiece 10.

As shown in FIG. 4, the electronic timepiece 10 has a control device 300 comprising a CPU (central processing unit), a storage device 200 including RAM 201 (random access memory) and EEPROM 202 (electronically erasable and programmable read only memory), a reception device 400 (GPS module), a timekeeping device 150, an input device 160, a detection device 170, the drive mechanism 140, and display device 141. These devices communicate with each other over a data bus.

The electronic timepiece 10 has a rechargeable storage battery 130 as the power source. The storage battery 130 is charged through a charging circuit 131 with power produced by the solar panel 135.

Input Device

The input device 160 includes the crown 55, button A 51, and button B 52 shown in FIG. 2. The crown 55 can move to a 0 stop position, first stop position, and second stop position. The crown 55 is normally at the 0 stop (pushed in). The input device 160 is an example of an operating unit.

Detection Mechanism

The detection device 170 detects user operations instructing executing specific processes based on pushing and releasing the buttons 51, 52 or pulling, pushing, and rotating the crown 55, and outputs an operating signal corresponding to the detected operation to the control device 300.

For example, the detection device 170 detects an enable correction mode operation for going to the time correction mode when the crown 55 moves from the 0 stop or the second stop to the first stop. When the detection device 170 detects the enable correction mode operation, it outputs a correction mode selection signal to the control device 300. When the correction mode selection signal is input, the control device 300 sets the first time correction mode for adjusting the first time.

When the crown 55 is at the first stop and the button B 52 is depressed, the detection device 170 detects the change correction mode operation for changing the type of the time correction mode. When the change correction mode operation is detected, the detection device 170 outputs a change correction mode signal to the control device 300. When the change correction mode signal is input, the control device 300 selects the second time correction mode for adjusting the second time.

The enable correction mode operation and the change correction mode operation are therefore both correction mode setting operations for setting the time correction mode.

When the first time correction mode or the second time correction mode is set and the crown 55 is turned, the detection device 170 detects a time zone correction operation, and when a time zone correction operation is detected, outputs a time zone correction signal to the control device 300. When the time zone correction signal is input, the control device 300 corrects the time zone data.

When the crown 55 is moved from the first stop to the 0 stop or the second stop, the detection device 170 detects a stop time correction operation instructing ending the time correction mode, and outputs a stop time correction signal to the control device 300 when the stop time correction operation is detected. When the stop time correction operation signal is input, the control device 300 exits the time correction mode.

Display Device

The display device 141 is embodied by the dial 11, subdial 83, dial ring 40, bezel 32, hands 21, 22, 23, 61, 71, 81, 82, 91, and calendar wheel 16 shown in FIG. 2.

Reception Device

The reception device 400 is connected to the antenna 110, processes satellite signals received through the antenna 110, and acquires GPS time information and positioning information. The antenna 110 receives satellite signal waves that are transmitted from the GPS satellites 100 and pass through the crystal 33 and dial ring 40 shown in FIG. 3.

While not shown in the figure, the reception device 400 includes an RF (radio frequency) unit that receives and converts satellite signals transmitted from the GPS satellites 100 to digital signals; a baseband unit that executes a reception signal correlation process and demodulates the navigation message; and a data acquisition unit that acquires GPS time information and positioning information from the navigation message (satellite signals) demodulated by the baseband unit.

Navigation Message (GPS Satellite)

The navigation message contained in the satellite signals sent from a GPS satellite 100 and carrying the acquired information described above is described next. Note that the navigation message is data modulated at 50 bps onto the satellite signal carrier.

Figure 5:
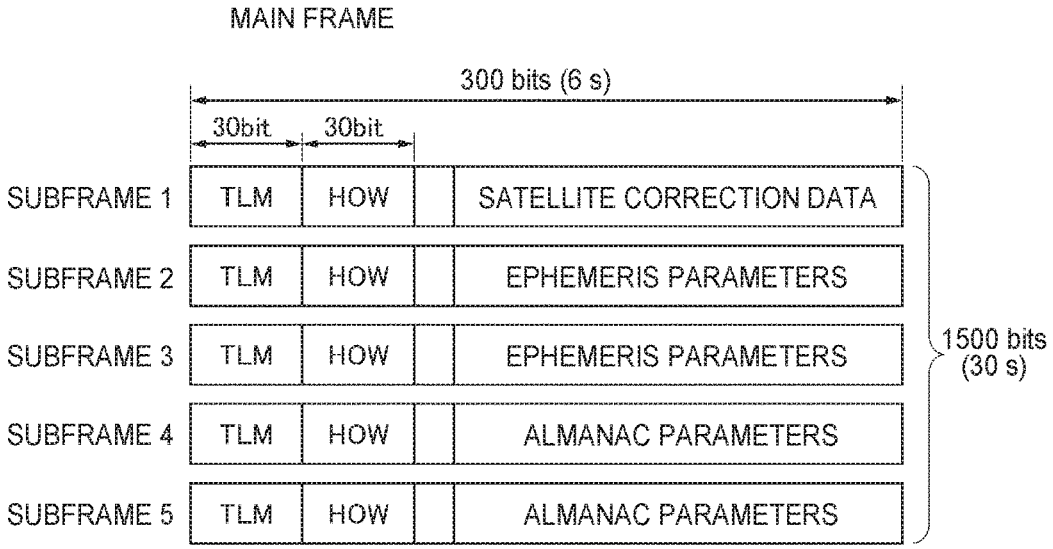
FIG. 5 illustrates the format of the main frame of the navigation message of a GPS satellite signal.
Figure 6:
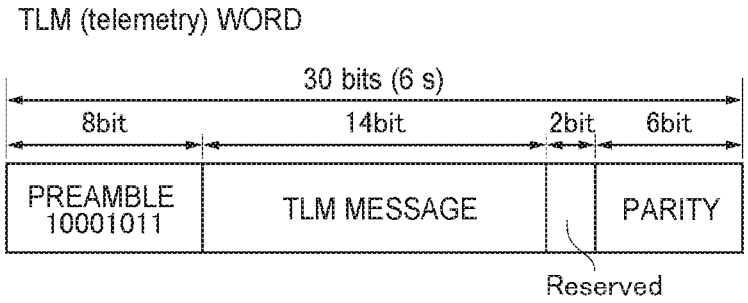
FIG. 6 illustrates the format of a TLM word in the navigation message.
Figure 7:
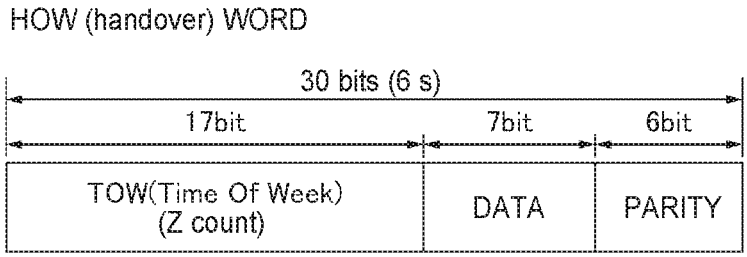
FIG. 7 illustrates the format of a HOW (HandOver Word) in the navigation message.

FIG. 5 to FIG. 7 describe the format of the navigation message.

As shown in FIG. 5, a navigation message is composed of main frames each containing 1500 bits. Each main frame is divided into five subframes 1 to 5 of 300 bits each. The data in one subframe is transmitted in 6 seconds from each GPS satellite 100. It therefore takes 30 seconds for the data in one main frame to be transmitted from a GPS satellite 100.

Subframe 1 contains the week number (WN) and satellite correction data.

The week number identifies the week to which the current GPS time information belongs, and is updated every week.

Subframes 2 and 3 contain ephemeris data (detailed orbit information for each GPS satellite 100). Subframes 4 and 5 contain almanac data (coarse orbit information for all GPS satellites 100).

Each of subframes 1 to 5 starts with a telemetry (TLM) word storing 30 bits of telemetry data followed by a HOW word (handover word) storing 30 bits of handover data.

Therefore, while the TLM and HOW words are transmitted at 6-second intervals from the GPS satellites 100, the week number data and other satellite correction data, ephemeris parameter, and almanac parameter are transmitted at 30-second intervals.

As shown in FIG. 6, the TLM word contains a preamble, a TLM message and reserved bits, and parity data.

As shown in FIG. 7, the HOW word contains GPS time information called the TOW or Time of Week (also called the Z count). The Z count denotes in seconds the time passed since 00:00 of Sunday each week, and is reset to 0 at 00:00 Sunday the next week. More specifically, the Z count denotes the time passed from the beginning of each week in seconds. The Z count denotes the GPS time at which the first bit of the next subframe data is transmitted.

The electronic timepiece 10 can therefore acquire date information and time information by retrieving the week number contained in subframe 1 and the HOW word (Z count data) contained in subframes 1 to 5. However, if the week number data was previously received and the time passed from when the week number was acquired is counted internally, the electronic timepiece 10 can know the current week number value of the GPS satellite 100 time without acquiring the week number from a satellite signal again.

The electronic timepiece 10 therefore only needs to acquire the week number value from subframe 1 when week number data (date information) is not already stored internally, such as after a device reset or when the power is first turned on. If the week number is stored, the electronic timepiece 10 can know the current time by simply acquiring the TOW value transmitted every 6 seconds. As a result, the electronic timepiece 10 normally acquires only the TOW as the time information.

Timekeeping Device

The timekeeping device 150 includes a crystal oscillator that is driven by power stored in the storage battery 130, and updates the time data using a reference signal based on the oscillation signal from the crystal oscillator.

Figure 8:
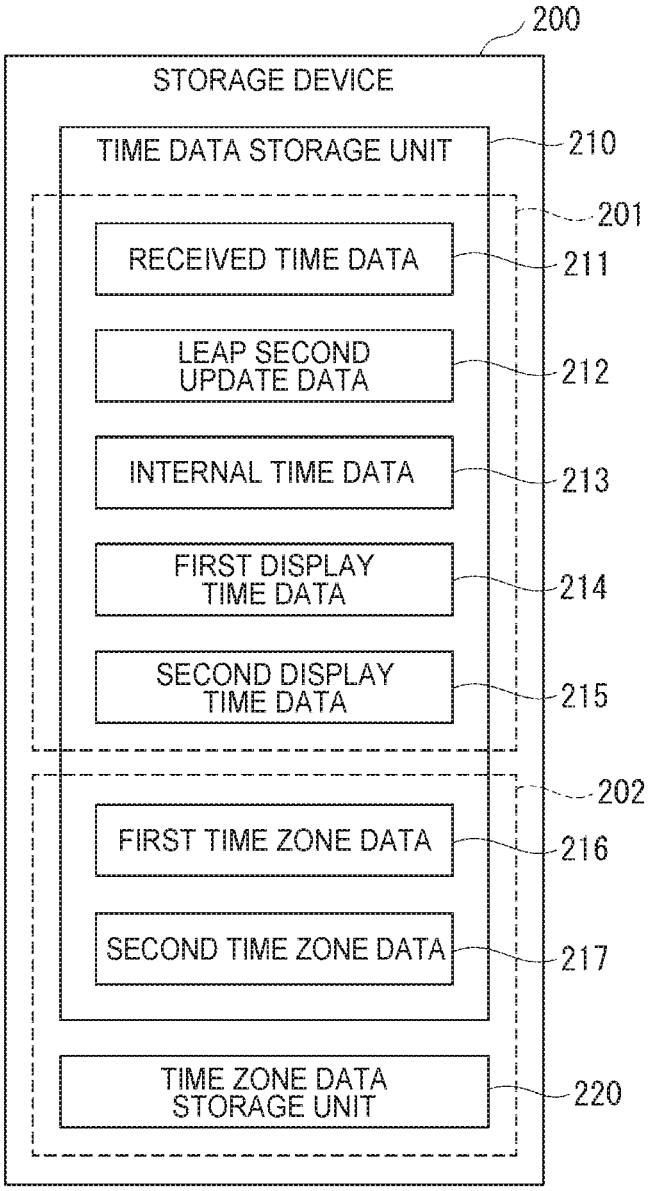
FIG. 8 illustrates the data structure of a storage device in the first embodiment of the invention.

The storage device 200, as shown in FIG. 8, includes a time data storage unit 210 and a time zone data storage unit 220.

Stored in the time data storage unit 210 are received time data 211, leap second update data 212, internal time data 213, first display time data 214, second display time data 215, first time zone data 216, and second time zone data 217.

In this embodiment of the invention, the received time data 211, leap second update data 212, internal time data 213, first display time data 214, and second display time data 215 are stored in RAM 201; and the first time zone data 216 and second time zone data 217 are stored in EEPROM 202.

The received time data 211 stores the time information (GPS time) acquired from GPS satellite signals. The received time data 211 is normally updated every second by the timekeeping device 150, and when a satellite signal is received, the acquired time information is stored.

The leap second update data 212 stores at least data about the current leap second. More specifically, the current leap second value, the week number of the leap second event, the day number of the leap second event, and the future leap second value, are stored on page 18 in subframe 4 of the GPS satellite signal as data related to the leap second. Of these values, at least the current leap second value is stored in the leap second update data 212.

The internal time data 213 stores internal time information. More specifically, the internal time data 213 is updated based on the GPS time stored in the received time data 211 and the current leap second value stored in the leap second update data 212. As a result, UTC is stored in the internal time data 213. When the received time data 211 is updated by the timekeeping device 150, the internal time data is also updated.

The sum of the internal time stored in the internal time data 213, and the time zone data (time difference information) of the first time zone data 216, is stored in the first display time data 214.

The first time zone data 216 is set to the time zone that is manually selected by the user or is acquired by reception in the navigation mode. The time expressed by the first display time data 214 is the first time that is displayed by the hands 21, 22, 23.

The second display time data 215 is set to the internal time expressed by the internal time data 213 and the time zone set in the second time zone data 217. The second time zone data 217 is the time zone that is manually set by the user. The time expressed by the second display time data 215 is the second time displayed by the hands 81, 82, 91.

Because the first time zone data 216 and second time zone data 217 are stored in EEPROM 202, which is a type of nonvolatile memory, the time zone data stored in the first time zone data 216 and second time zone data 217 remains in memory even if the electronic timepiece 10 shuts down or is reset. When the electronic timepiece 10 boots, the first display time data 214 is initialized to 00:00, and the second display time data 215 is set to the time reflecting the time difference between the time zone of the first time zone data 216 and the time zone of the second time zone data 217.

For example, if the first time zone data 216 is set to +9 hours, and the second time zone data 217 is set to +0 hours, the first display time data 214 is initialized to 00:00, and the second display time data 215 is set to 15:00, when the system boots.

In another example, if the first time zone data 216 is set to +3 hours, and the second time zone data 217 is set to +6 hours, the first display time data 214 is initialized to 00:00, and the second display time data 215 is set to 03:00, when the system boots.

In another example, if the first time zone data 216 is set to +0 hours, and the second time zone data 217 is set to −5 hours, the first display time data 214 is initialized to 00:00, and the second display time data 215 is set to 19:00, when the system boots.

Because the time zone setting of the first time and second time are not erased and remain in memory even if the electronic timepiece 10 is reset, there is no need to reset the time zone after the electronic timepiece 10 reboots.

Furthermore, because the first time is initialized to 00:00 when the electronic timepiece 10 boots, the user knows that the time must be set (corrected).

The time zone data storage unit 220 is configured in EEPROM 202. The time zone data storage unit 220 relationally stores positioning information (latitude, longitude) and time zone data (time difference information). As a result, when positioning information is acquired in the navigation mode, the control device 300 can acquire the time zone data based on the positioning information (latitude, longitude). While the time zone setting process is described in detail below, note that the control device 300 can also acquire time zone data from the time zone data storage unit 220 by operation of the crown 55.

Control Device

The control device 300 is embodied by a CPU that controls the electronic timepiece 10. By running a time adjustment (correction) programs stored in the storage device 200, the control device 300 functions as a timekeeping reception controller 310, a positioning reception controller 320, a correction mode setting unit 330, a display controller 340, a time zone setting unit 350, and a time correction unit 360.

The timekeeping reception controller 310 operates the reception device 400 to run the reception process in the timekeeping mode. The positioning reception controller 320 also operates the reception device 400 to run the reception process in the positioning (navigation) mode.

The correction mode setting unit 330 sets the first time correction mode or the second time correction mode.

The display controller 340 controls movement of the hands.

The time zone setting unit 350 sets the time zone of the first time and the time zone of the second time.

The time correction unit 360 corrects the first time and the second time.

The functions of these parts are described below in detail by the processes executed by the control device 300.

Control Process

Figure 9:
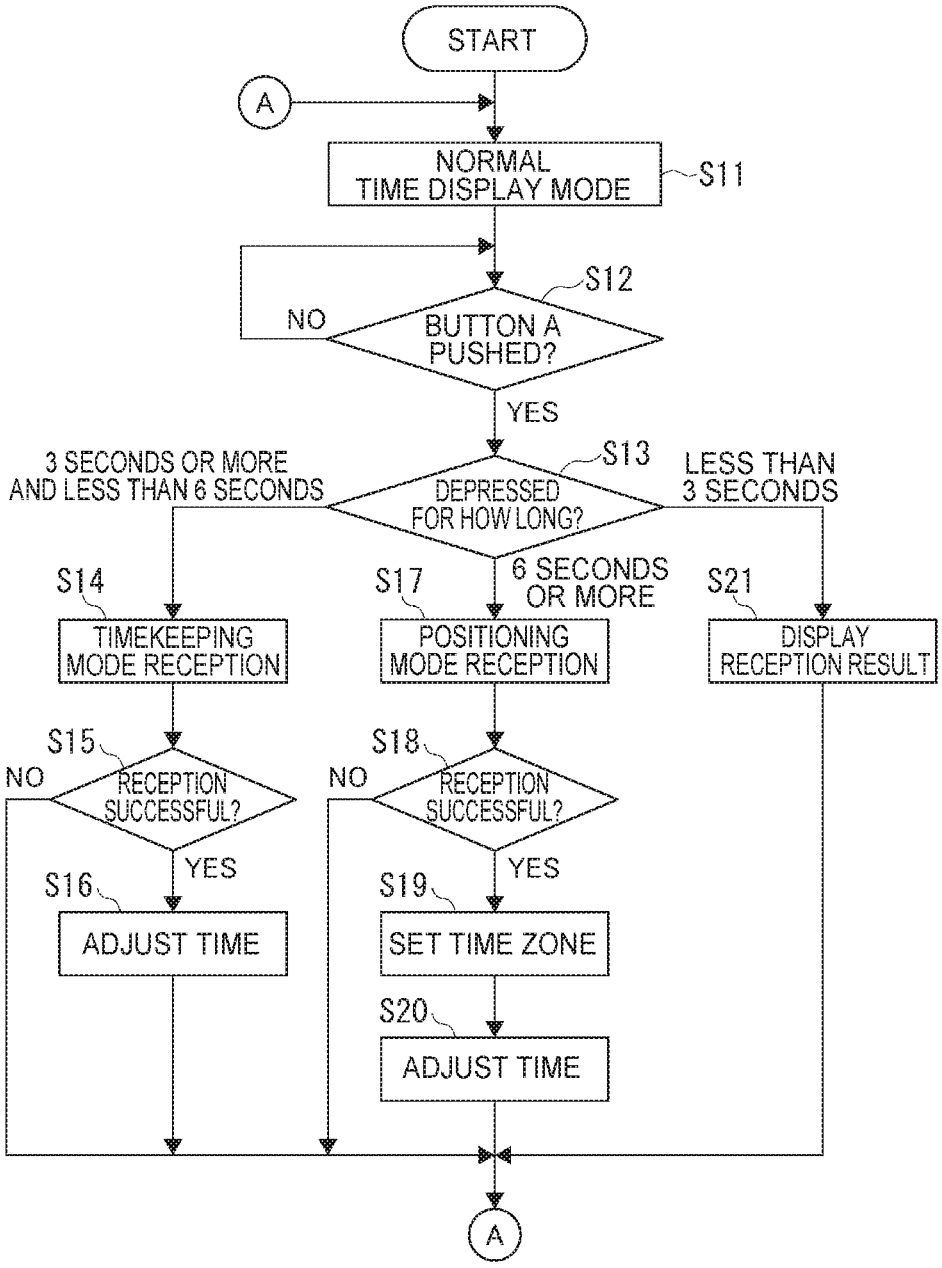
FIG. 9 is a flow chart of the control process in the first embodiment of the invention.

The control process executed by the control device 300 when a button is pushed in the normal time display mode is described below. FIG. 9 is a flow chart of the control process executed by the control device 300.

In the normal time display mode (S11), the control device 300 continuously detects if button A 51 was operated based on the operation signal input from the detection device 170 (S12). Note that in the normal time display mode, the crown 55 is at the 0 stop position.

If the control device 300 determines the button A 51 was pressed (S12 returns YES), the device 300 determines how long the button A 51 is continuously pressed (S13).

If the button A 51 is pressed for 3 seconds or more and less than 6 seconds (the operation forcing reception in the timekeeping mode), the timekeeping reception controller 310 operates the reception device 400 and runs the reception process in the timekeeping mode (S14). When the reception process runs in the timekeeping mode, the reception device 400 locks onto to at least one GPS satellite 100, receives satellite signals transmitted from that GPS satellite 100, and acquires time information.

Next, the control device 300 determines if acquisition of time information was successful (S15).

If S15 returns YES, the display controller 340 sets the second hand 21 to Y to indicate that reception was successful.

The time correction unit 360 also stores the acquired time information in the received time data 211. As a result, the internal time data 213, first display time data 214, and second display time data 215 are corrected (S16).

If S15 returns NO, the display controller 340 sets the second hand 21 to N to show that reception failed.

After step S16, and if S15 returns NO, the device 300 returns to the normal time display mode in S11, and the display controller 340 sets the second hand 21 to point to the second of the first time.

If the button A 51 is pressed for 6 seconds or more and the operation forcing reception in the navigation mode is performed, the positioning reception controller 320 operates the reception device 400 and runs the reception process in the navigation mode (S17). When the reception process runs in the navigation mode, the reception device 400 locks onto to at least three, and preferably four or more, GPS satellites 100, receives satellite signals transmitted from those GPS satellites 100 and acquires positioning information. The reception device 400 simultaneously acquires time information when receiving the satellite signals in this event.

Next, the control device 300 determines if acquisition of the positioning information was successful (S18).

If S18 returns YES, the display controller 340 sets the second hand 21 to point to the Y, indicating that reception was successful.

The time zone setting unit 350 then sets the time zone data based on the acquired positioning information (latitude, longitude) (S19). More specifically, the time zone setting unit 350 selects and acquires the time zone data (time difference information) corresponding to the positioning information from the time zone data storage unit 220, and stores (sets) the time zone data in the first time zone data 216.

For example, because Japan Standard Time (JST) is nine hours ahead of UTC (UTC+9), if the acquired positioning information is a location in Japan, the time zone setting unit 350 reads the time difference (+9 hours) for JST from the time zone data storage unit 220, and stores this time difference in the first time zone data 216.

The time correction unit 360 then stores the acquired time information in the received time data 211. As a result, the internal time data 213, first display time data 214, and second display time data 215 are corrected.

The time correction unit 360 then corrects the first display time data 214 using the first time zone data 216 (S20). As a result, the first display time data 214 is adjusted to the internal time data 213 (UTC) plus the value of the time zone data.

If S18 returns NO, the display controller 340 sets the second hand 21 to N to indicate that reception failed.

After S20, and if S18 returns NO, the control device 300 returns to the normal display mode in S11, and the display controller 340 sets the second (time zone) hand 21 to the second of the first time.

If button A 51 is pushed for less than 3 seconds and the display reception result operation is performed, the display controller 340 indicates the result of the last reception process by setting the second hand 21 to Y or N (S21). Next, if button B 52 is pushed or a set display time (such as 5 seconds) passes, the control device 300 returns to the normal display mode in S11, and the display controller 340 sets the second hand 21 to the second of the first time.

Time Zone Setting Process

The time zone setting process executed by the control device 300 is described next.

Figure 10:
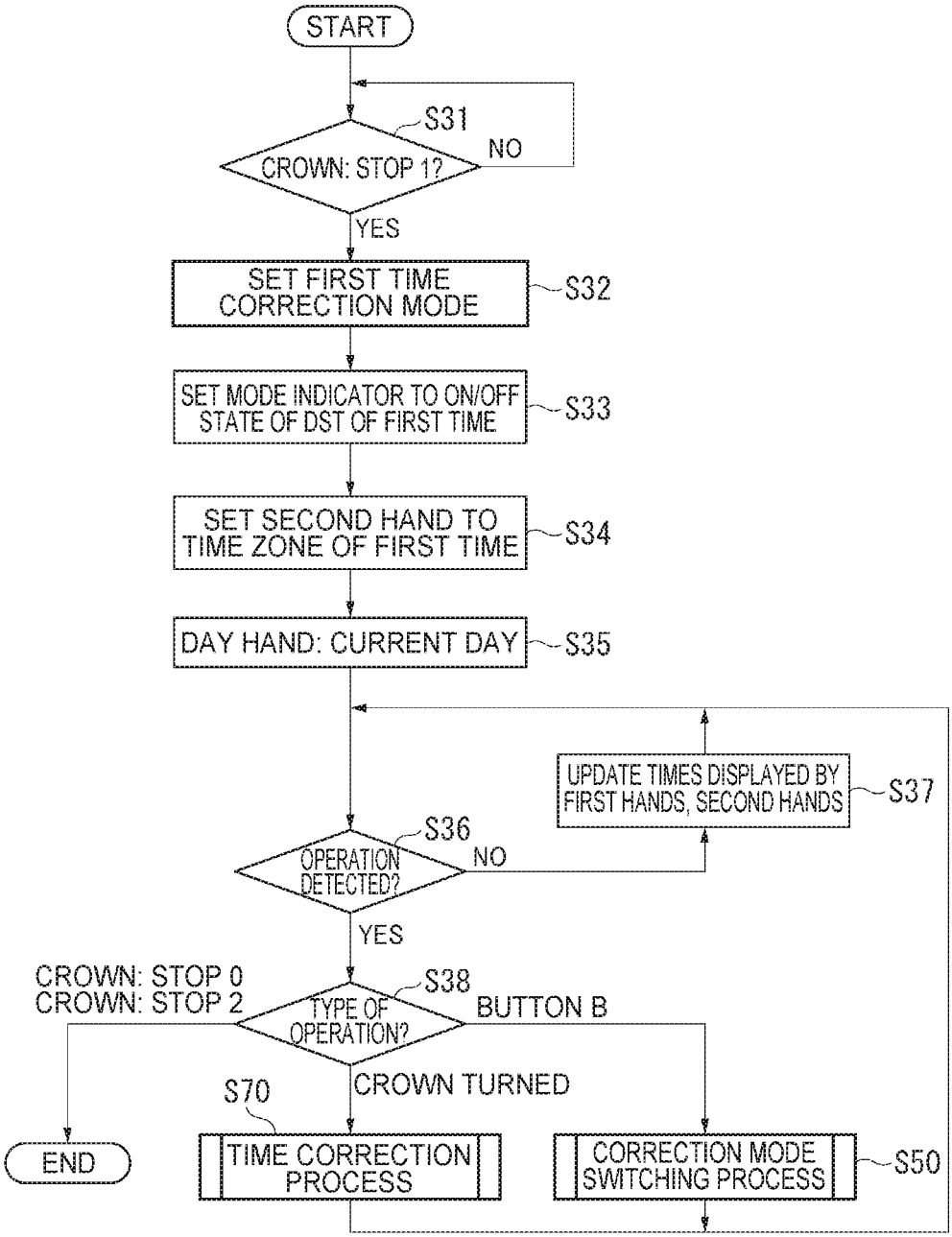
FIG. 10 is a flow chart of the time zone setting process in the first embodiment of the invention.
Figure 11:
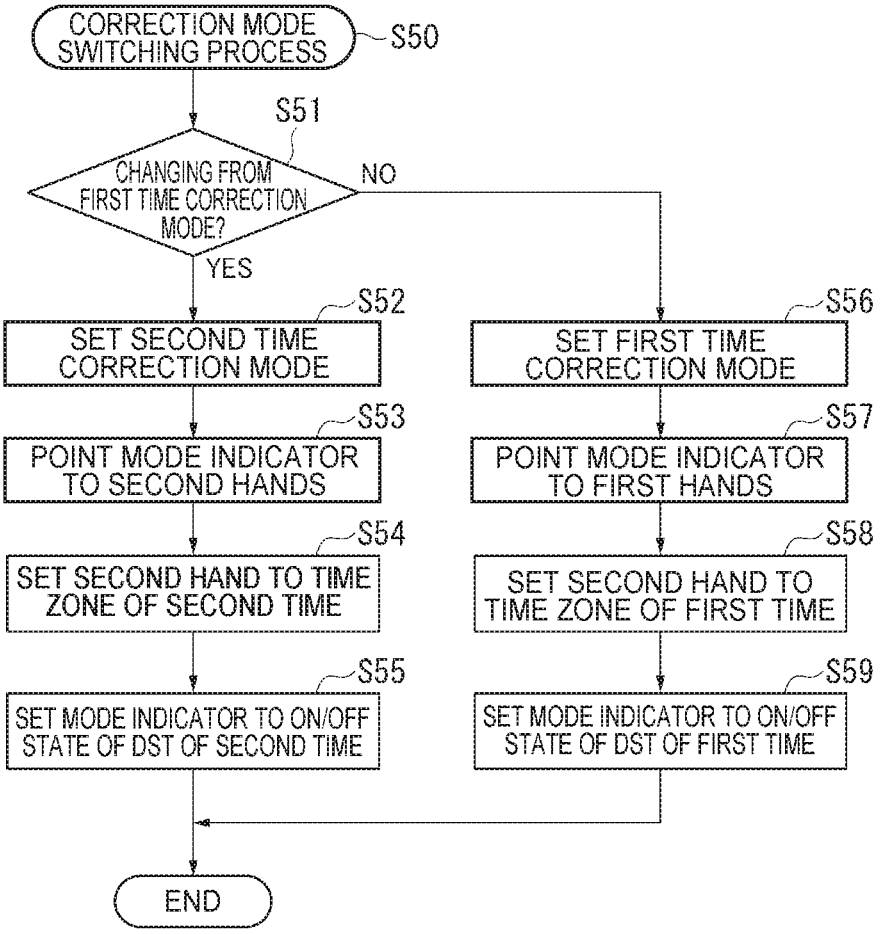
FIG. 11 is a flow chart of the correction mode switching process in the first embodiment of the invention.
Figure 12:
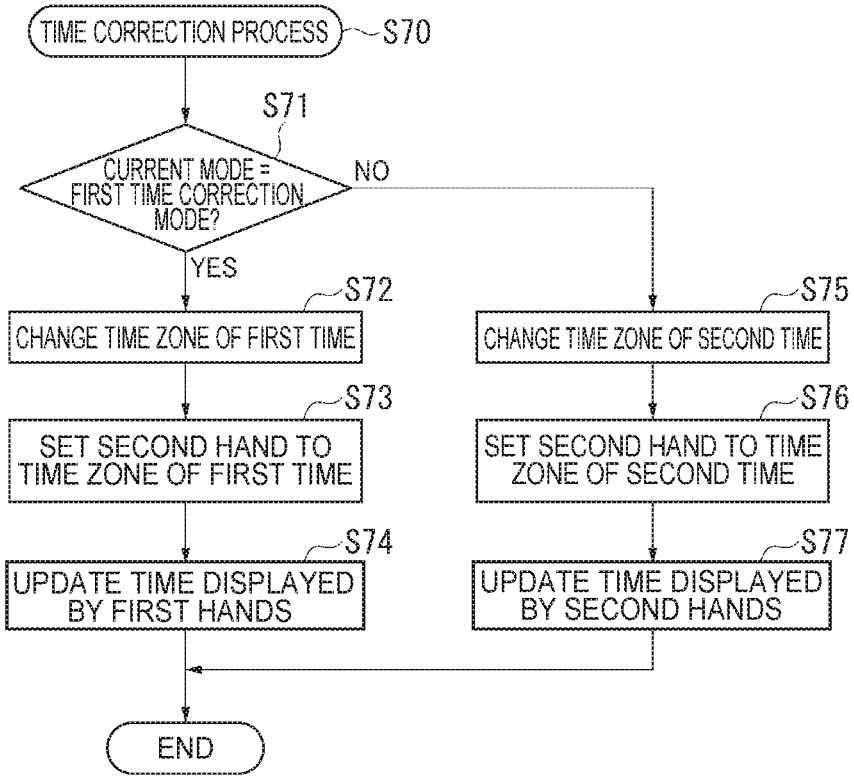
FIG. 12 is a flow chart of the time correction process in the first embodiment of the invention.

FIG. 10 is a flow chart of the time zone setting process. FIG. 11 is a flowchart of the of the correction mode switching process S50 in the time zone setting process, and FIG. 12 is a flow chart of the time correction process S70 in the time zone setting process.

As shown in FIG. 10, the correction mode setting unit 330 determines if the crown 55 was moved to the first stop (S31). If S31 returns NO, decision step S31 repeats.

If the crown 55 is moved to the first stop and the enable correction mode operation is detected, S31 returns YES, and the correction mode setting unit 330 sets the first time correction mode as the initial mode (S32).

Figure 13:
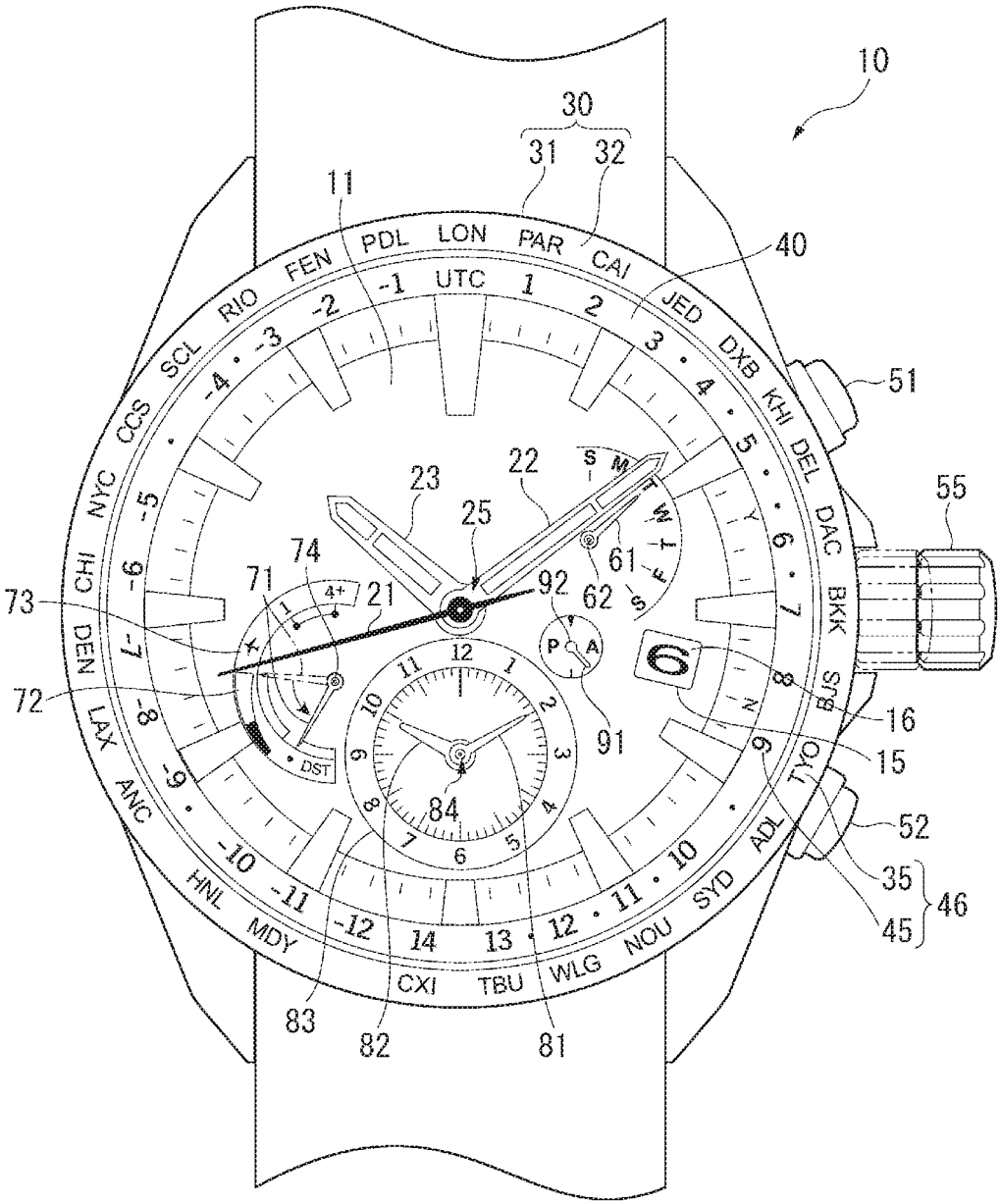
FIG. 13 shows an example of the display changing in an electronic timepiece according to the first embodiment of the invention.

When the first time correction mode is set, the display controller 340 moves the hand 71 (mode indicator) counterclockwise as shown in FIG. 13 to point to the DST or the black dot and thereby indicate the DST setting at the first time (S33).

Figure 14:
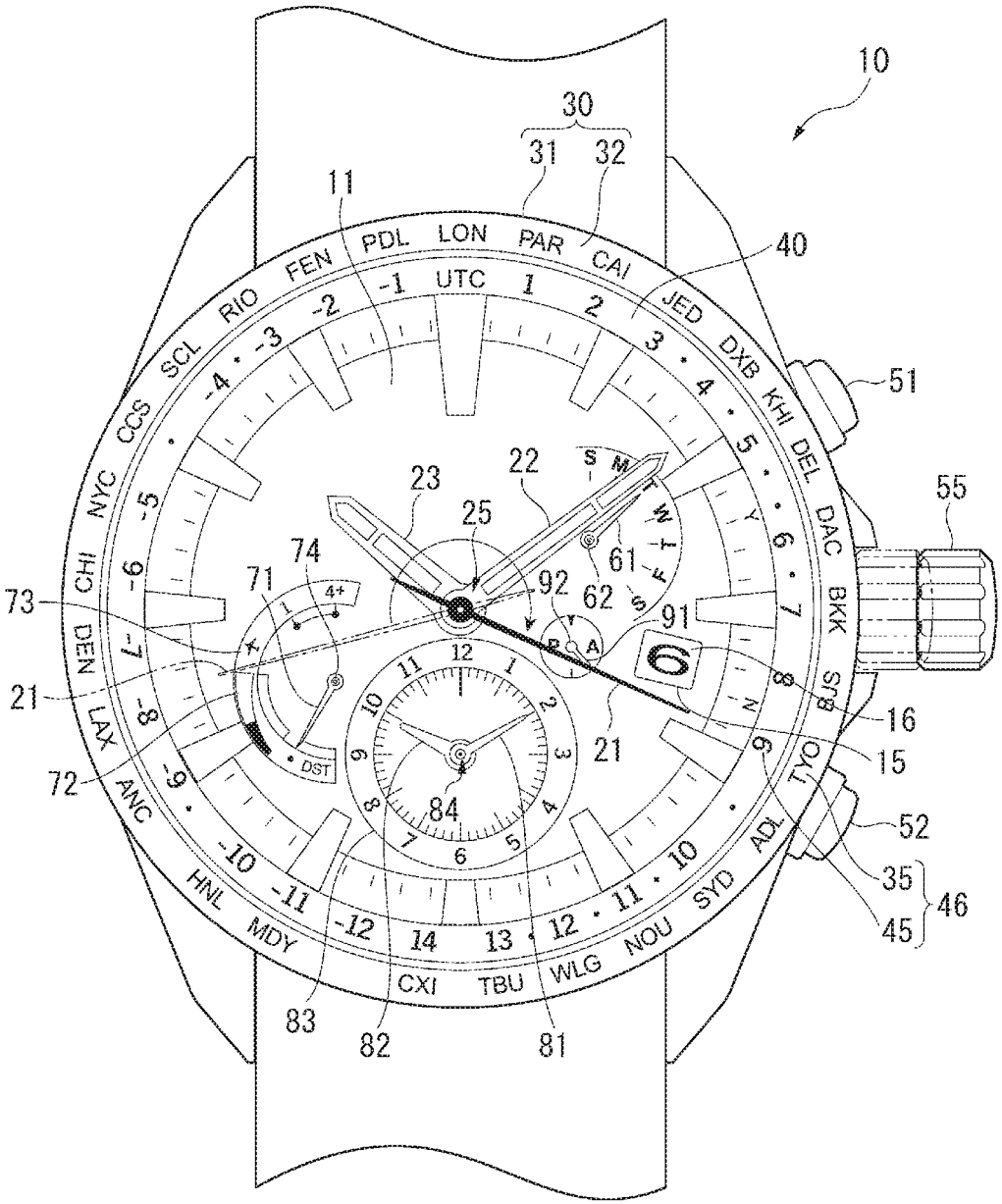
FIG. 14 shows an example of the display changing in an electronic timepiece according to the first embodiment of the invention.

After the hand 71 points to DST or the black dot, the display controller 340 moves the time zone hand 21 (second hand) rapidly clockwise as shown in FIG. 14 to point to the appropriate position on the time zone display 46 and thereby indicate the time zone setting (time zone setting of the first time) stored in the first time zone data 216 (S34).

The display controller 340 also sets the hand 61 (day hand) to the appropriate marker from Sunday to Saturday to also indicate the day of the week at the first time (S35).

Next, the control device 300 determines if the input device 160 was operated, that is, if the crown 55 or button B 52 was operated (S36).

If S36 returns NO, the display controller 340 updates the hour and minute of the first time indicated by hands 22, 23, and the hour and minute of the second time indicated by hands 81, 82 (S37). The control device 300 then returns to S36.

If S36 returns YES, the control device 300 determines the type of operation performed (S38).

If in S38 button B 52 is pushed and the change correction mode operation is performed, the control device 300 executes the correction mode switching process S50.

As shown in FIG. 11, when the correction mode switching process S50 executes, the correction mode setting unit 330 determines if the mode that was set immediately before the button B 52 was pushed was the first time correction mode (S51). Because the first time correction mode is set first, S51 returns YES.

If S51 returns YES, the correction mode setting unit 330 sets the second time correction mode (S52).

Figure 15:
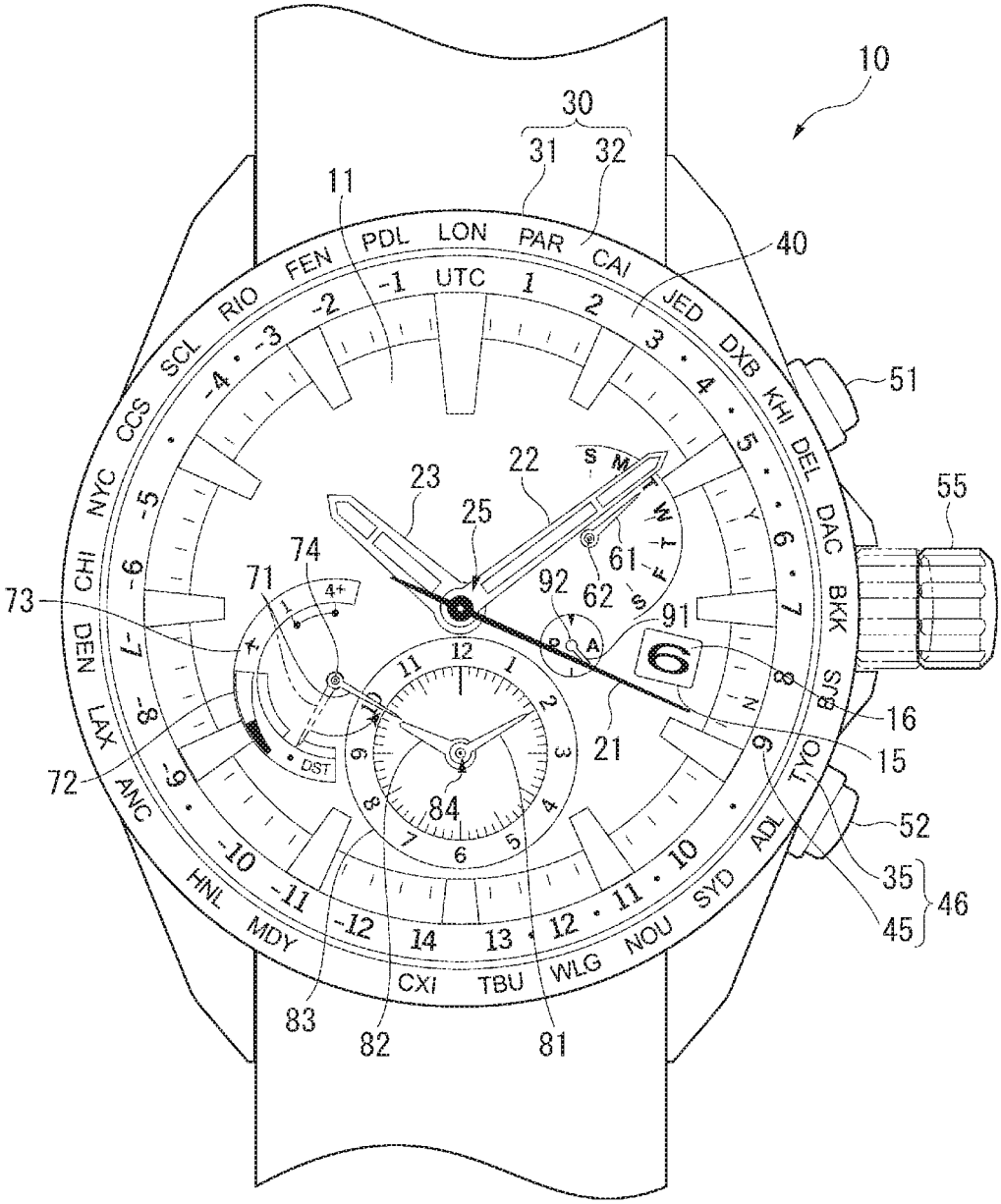
FIG. 15 shows an example of the display changing in an electronic timepiece according to the first embodiment of the invention.

As shown in FIG. 15, the display controller 340 moves the hand 71, which was indicating the DST setting, counterclockwise to point to a second indicated position showing that the hands to be adjusted are the hands 81, 82 (second hands) (S53). In this embodiment, the display controller 340 sets the hand 71 to point to the pivot 84 of the hands 81, 82 as the second indicated position.

Figure 16:
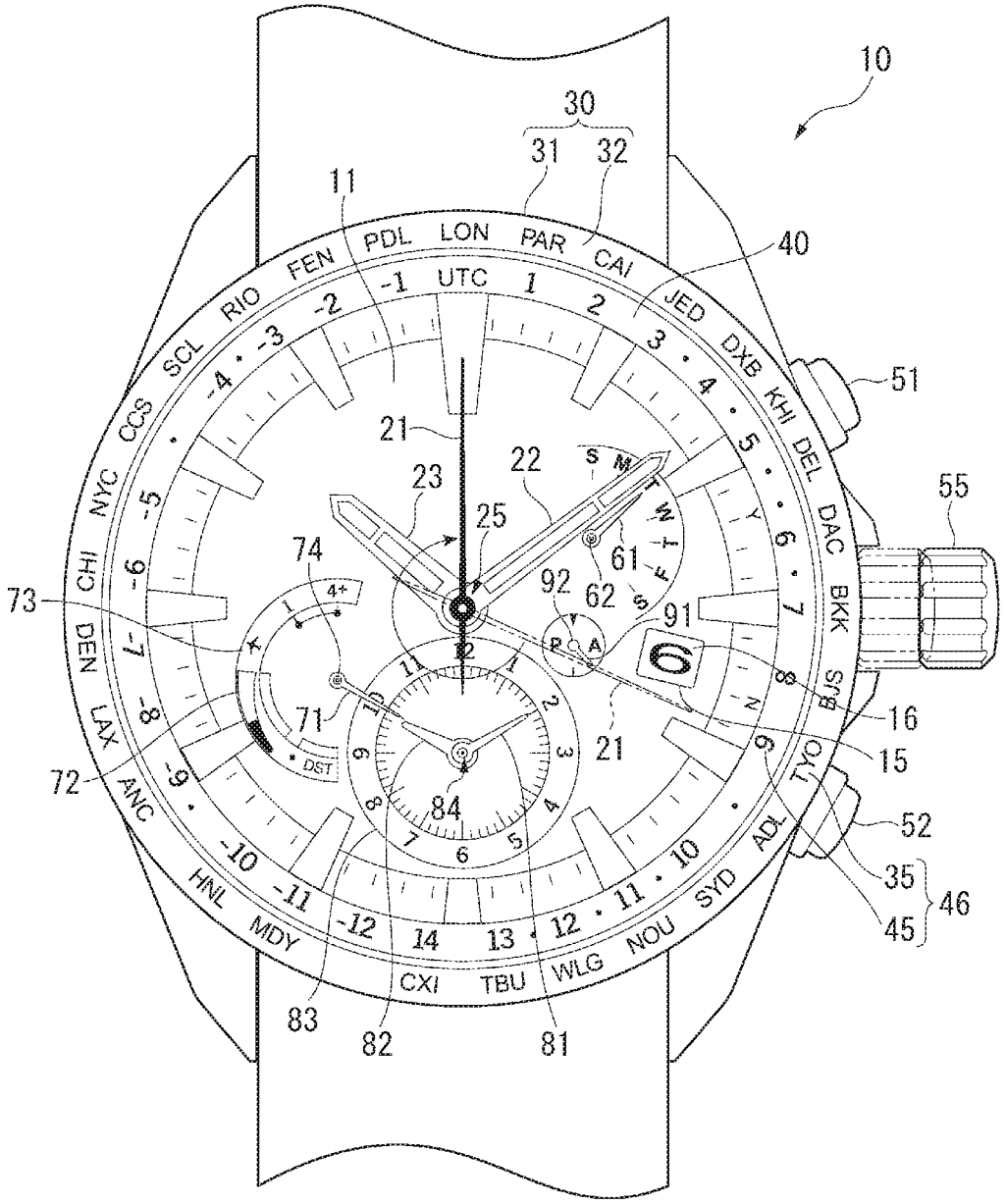
FIG. 16 shows an example of the display changing in an electronic timepiece according to the first embodiment of the invention.

As shown in FIG. 16, after the hand 71 points to the second indicated position, the display controller 340 quickly moves the time zone hand 21, which was indicating the time zone of the first time, clockwise to indicate the time zone data (the time zone of the second time) stored in the second time zone data 217 (S54).

Figure 17:
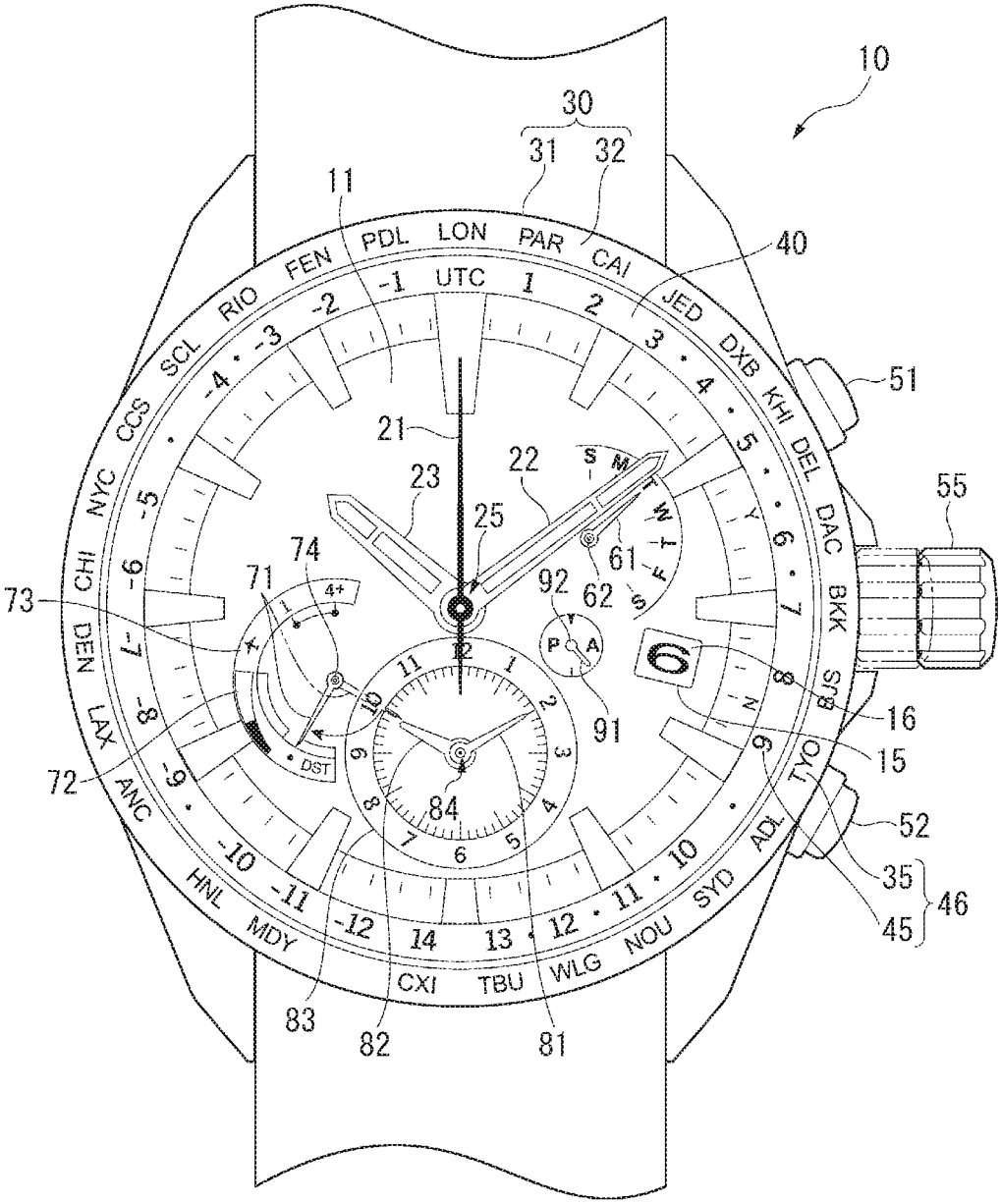
FIG. 17 shows an example of the display changing in an electronic timepiece according to the first embodiment of the invention.

After the time zone hand 21 indicates the time zone of the second time, the display controller 340 moves the hand 71 clockwise as shown in FIG. 17 to indicate the DST setting at the second time (S55). The control device 300 then ends the correction mode switching process S50 and returns to S36. Whether or not the input device 160 was operated is then determined in S36.

If button B 52 is pushed again, S36 returns YES, S38 determines that the change correction mode operation was performed, and the correction mode switching process S50 executes. Because the mode that was just set is the second time correction mode in this case, S51 returns NO. In this event, the correction mode setting unit 330 sets the first time correction mode (S56).

Figure 18:
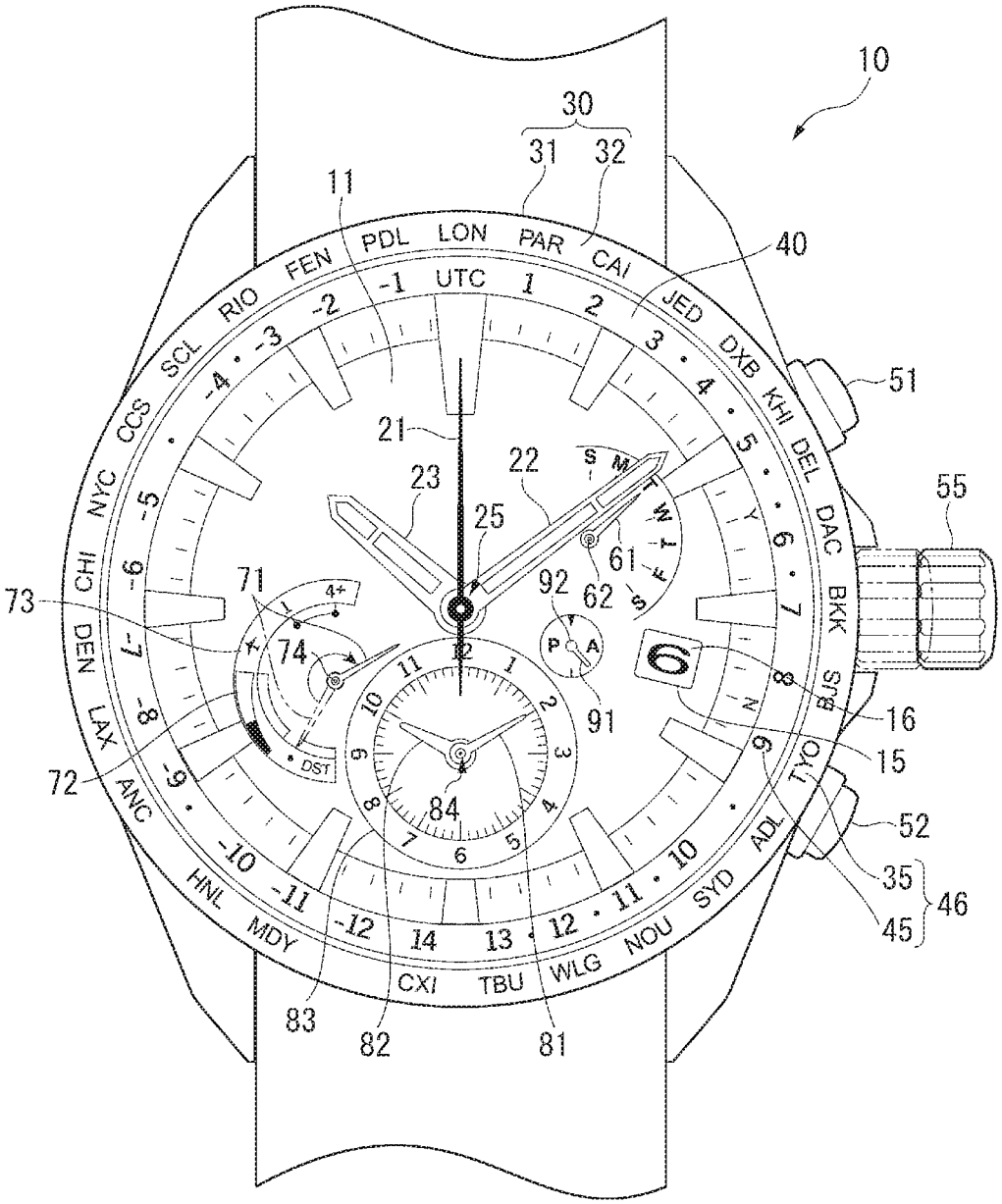
FIG. 18 shows an example of the display changing in an electronic timepiece according to the first embodiment of the invention.

As shown in FIG. 18, the display controller 340 then moves the hand 71, which was indicating the DST setting at the second time, clockwise to point to the first indicated position, indicating that the hands to be corrected are the hands 22, 23 (first hands) (S57). In this example, the display controller 340 sets the hand 71 to point to the location of the center pivot 25 of the hands 22, 23 as the indicated position.

Figure 19:
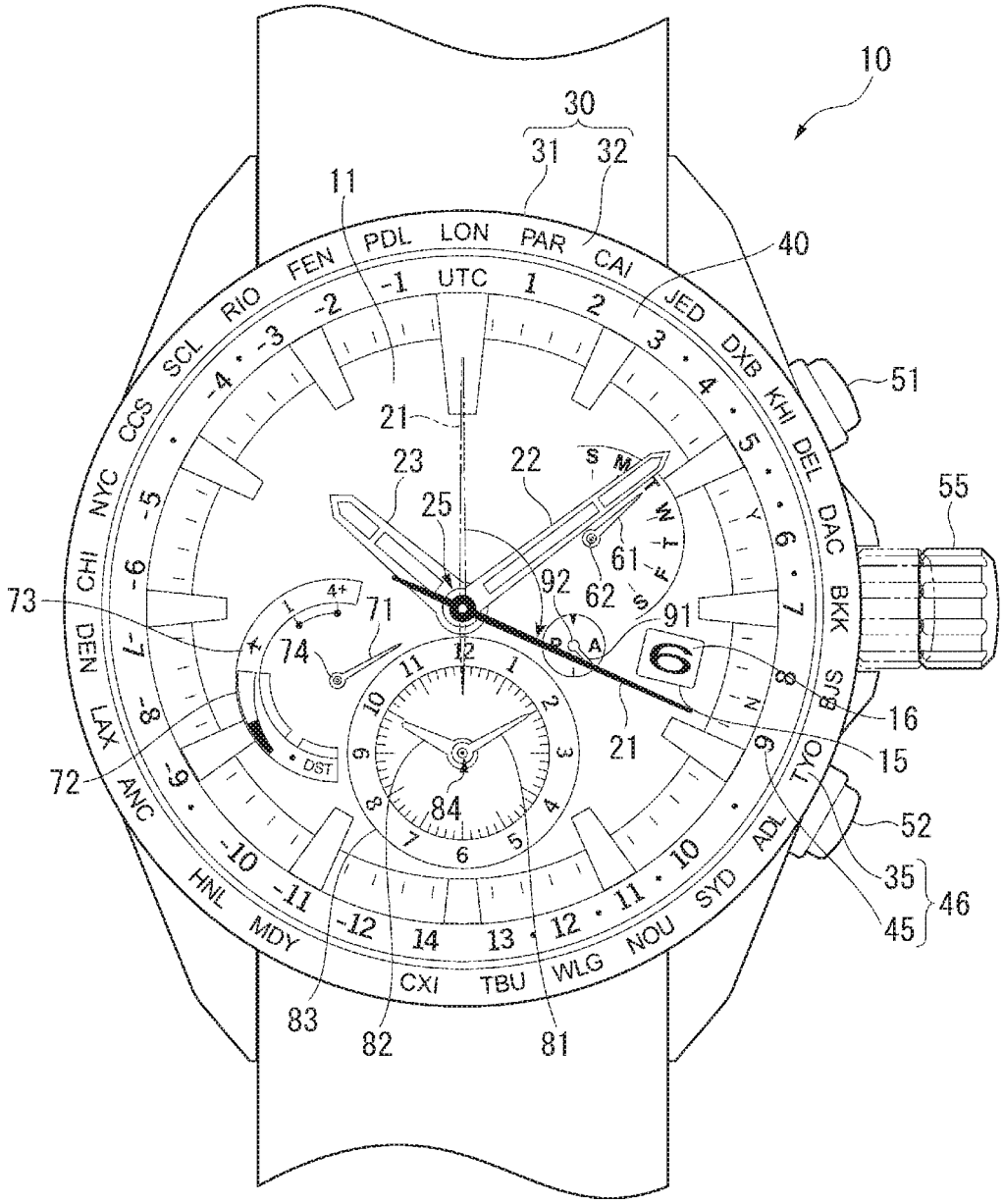
FIG. 19 shows an example of the display changing in an electronic timepiece according to the first embodiment of the invention.

As shown in FIG. 19, after the hand 71 points to the first indicated position, the display controller 340 moves the time zone hand 21 quickly clockwise to indicate the time zone setting of the first time (S58).

Figure 20:
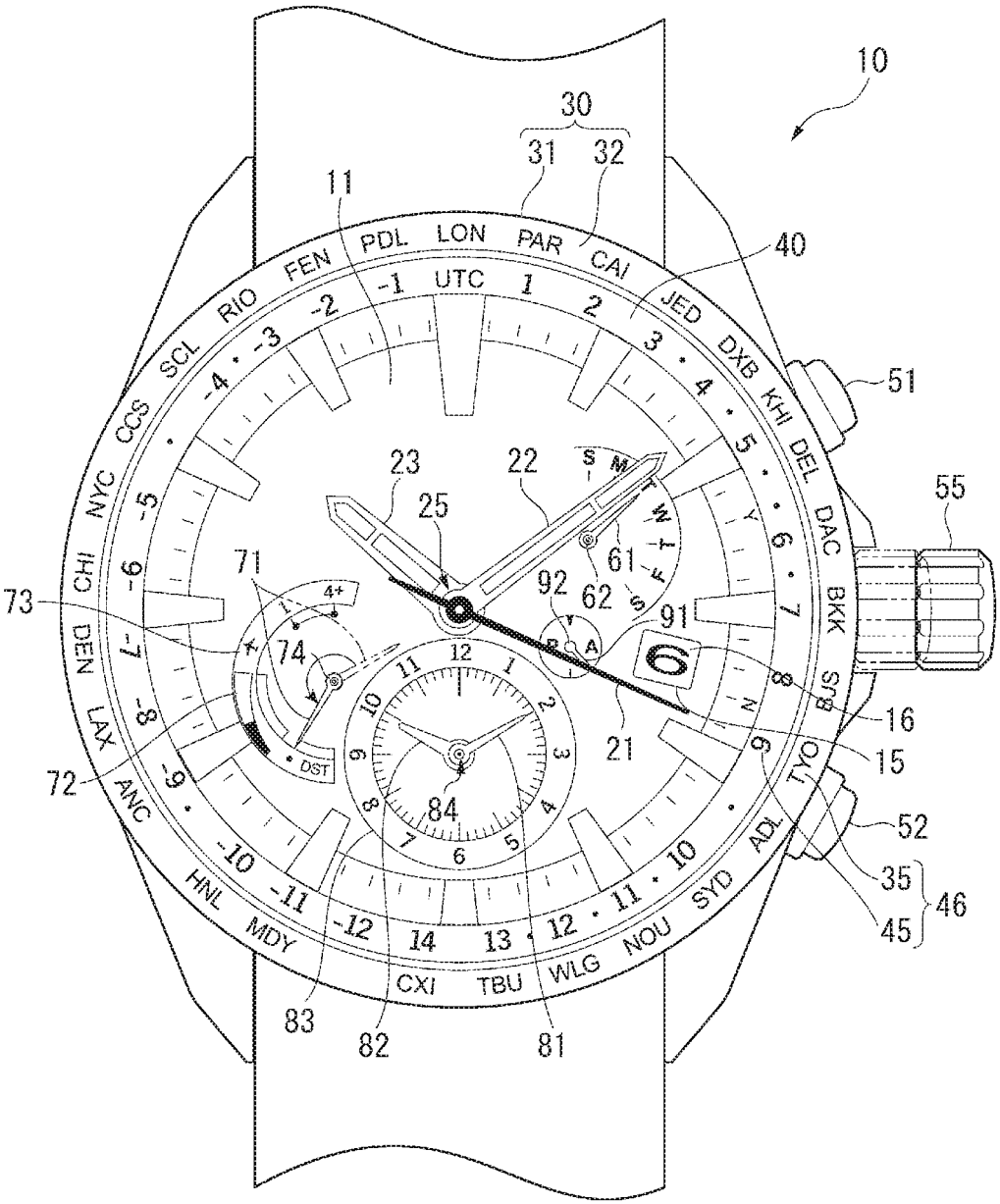
FIG. 20 shows an example of the display changing in an electronic timepiece according to the first embodiment of the invention.

After the time zone hand 21 indicates the time zone of the first time, the display controller 340 moves the hand 71 counterclockwise as shown in FIG. 20 to indicate the DST setting at the first time (S59). The control device 300 then ends the correction mode switching process S50 and returns to S36.

As described above, the correction mode switching process S50 executes each time the button B 52 is pushed, and the process of steps S52 to S55 and steps S56 to S59 are executed alternately.

If in S38 the crown 55 is turned in a time zone correction operation that advances or reverses the time zone setting a specific time (such as 1 hour), the control device 300 executes the time correction process S70.

As shown in FIG. 12, when the time correction process S70 executes, the control device 300 determines if the currently set mode is the first time correction mode (S71).

If S71 returns YES, the time zone setting unit 350 adjusts (changes) the time zone setting of the first time according to the time zone correction operation (S72). More specifically, the time zone setting unit 350 acquires time zone data corresponding to the time zone correction operation from the time zone data storage unit 220, and stores the acquired time zone data in the first time zone data 216.

Next, the display controller 340 sets the second hand 21 to indicate the time zone setting of the first time zone data 216 (S73).

In addition, the time correction unit 360 corrects the first display time data 214 using the time zone data stored in the first time zone data 216. The display controller 340 then updates the hour and minute of the first time indicated by hands 22, 23 (S74). The control device 300 then ends the time correction process S70 and returns to S36.

If S71 returns NO, that is, if the currently set mode is the second time correction mode, the time zone setting unit 350 corrects (changes) the time zone setting of the second time appropriately to the time zone correction operation (S75). More specifically, the time zone setting unit 350 acquires the time zone data corresponding to the time zone correction operation from the time zone data storage unit 220, and stores the acquired time zone data in the second time zone data 217.

Next, the display controller 340 sets the second hand 21 to indicate the time zone set for the second time zone data 217 (S76).

The time correction unit 360 also corrects the second display time data 215 using the time zone data stored in the second time zone data 217. The display controller 340 then corrects the hands 81, 82 to indicate the hour and minute of the second time (S77). The control device 300 then ends the time correction process S70 and returns to S36.

The displayed first time or second time is thus adjusted each time the crown 55 is turned to advance or reverse the time zone setting a specific time. As a result, the user can reset the time zone data while checking the time reflecting the time zone setting.

If the stop time correction operation is detected in S38 as a result of the crown 55 being pushed from the first stop to the 0 stop or pulled out to the second stop, the control device 300 ends the time zone setting process. As a result, the time zone of the first time or the second time is set. The display controller 340 also moves the hand 71 to indicate the remaining battery capacity, and moves the time zone hand 21 to indicate the second of the first time.

If button A 51 is pushed for 3 seconds or more in the time zone setting process when the first time correction mode is set, the DST setting of the first time switches between ON and OFF. If the second time correction mode is set and button A 51 is pushed for 3 seconds or more, the DST setting of the second time switches between ON and OFF.

Effect of Embodiment 1

By reading hand 71 in the electronic timepiece 10 according to this embodiment, the user can easily know whether the first time correction mode is set or the second time correction mode is set, and can easily adjust the desired time.

If when the enable correction mode operation is performed the user already knows that the first time correction mode is set, the user can know that the first time correction mode is set when the enable correction mode operation is performed without the hand 71 pointing to the first indicated position. As a result, when the first time correction mode is set by the enable correction mode operation, the user can quickly correct the first time without waiting for the hand 71 to move after the enable correction mode operation is performed.

The display controller 340 sets the hand 71 to point to the center pivot 25 of the hands 22, 23 as the first indicated position, and sets the hand 71 to point to the pivot 84 of the hands 81, 82 as the second indicated position. As a result, whether the hands to be adjusted (corrected) are the hands 22, 23 or the hands 81, 82 can be clearly shown.

When the user corrects the first time or the second time to the time in a different region, it may also be desirable to adjust the DST setting. With the electronic timepiece 10 according to this embodiment, the user can check the DST setting by reading the hand 71 after pointing to the first indicated position or second indicated position. As a result, if adjusting the DST setting is needed, the DST setting can be adjusted by operating the input device 160, and ease of use is improved. Furthermore, because a separate hand is not needed to indicate the DST setting, the number of hands on the electronic timepiece 10 can be decreased. Furthermore, after the hand 71 points to the first indicated position or second indicated position, the user can know the DST setting without manipulating the input device 160, and operation is simplified.

The user can also change the first time or the second time to the time in a different region by changing the time zone setting of the first time or the second time. Operation is therefore easier than a configuration in which the input device 160 must be operated to change the time indicated by the hands 22, 23 or the hands 81, 82 to the time in the other region.

When the user changes the first time or the second time, the user can check the time zone setting and know whether or not the time zone must be corrected by reading the time zone hand 21 indicating the time zone.

When the first time correction mode or the second time correction mode is set by the change correction mode operation, the display controller 340 moves the hand 71 to the first indicated position or the second indicated position, then moves the time zone hand 21 to indicate the time zone, and then moves the hand 71 to indicate the DST setting.

Peak power consumption can therefore be reduced compared with a configuration in which hand 71 and hand 21 move simultaneously.

Furthermore, because hand 21 is configured to indicate time zone data for both the first time and the second time, the user cannot correctly know the time zone setting if the user does not know whether the time zone indicated by hand 21 is the time zone of the first time or the second time.

However, by moving hand 71 before hand 21, the user can more quickly determine time zone than when hand 71 moves after hand 21.

Because center pivot 25 is located in the plane center of the dial 11, longer hands 21, 22, 23 can be used than when the center pivot 25 is offset to the outside from the plane center of the dial 11. The first time and the time zone data can therefore be displayed with a dynamic movement.

Because the display controller 340 moves the hands 22, 23, 81, 82 continuously when the first time correction mode or second time correction mode is set, the user can check the current time and adjust the first time or the second time by reading the hands 22, 23 or hands 81, 82 after the first time correction mode or second time correction mode is entered.

Embodiment 2

When the first time correction mode or second time correction mode is set in the correction mode switching process S50, the display controller 340 of the electronic timepiece 10 according to the first embodiment of the invention moves the hand 71 to indicate the first indicated position or second indicated position, and then moves the time zone hand 21 to indicate the time zone setting. In an electronic timepiece according to the second embodiment of the invention, the display controller 340 moves hand 71 and hand 21 simultaneously. If a previously set display time then passes after the hand 71 is set to the first indicated position or the second indicated position, the hand 71 moves to indicate the DST setting. Note that the configuration of an electronic timepiece according to the second embodiment of the invention is the same as the configuration of the electronic timepiece 10 of the first embodiment.

Figure 21:
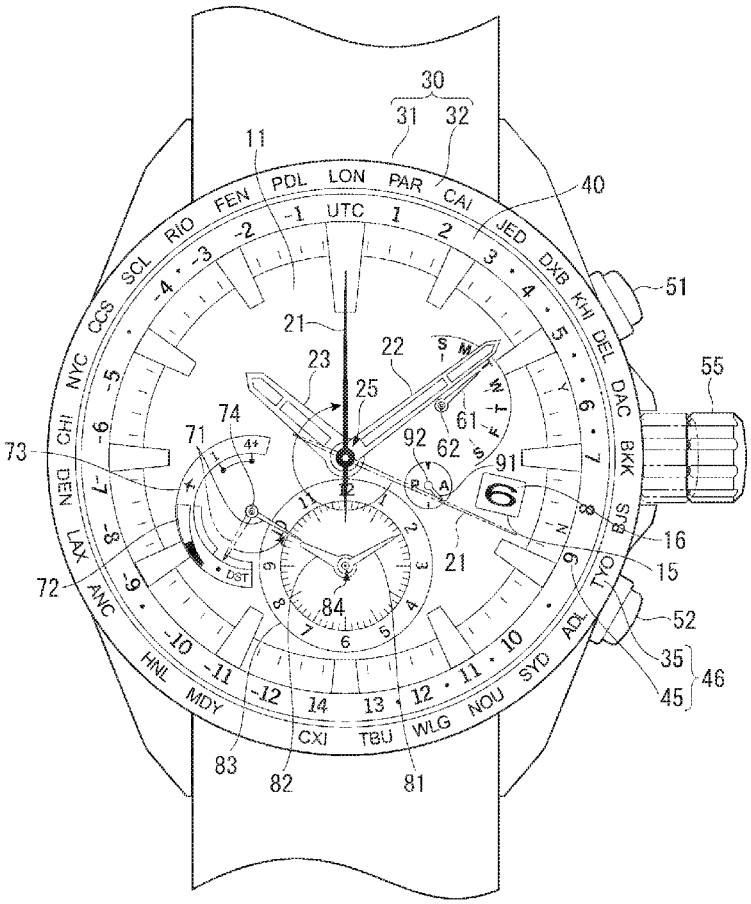
FIG. 21 shows an example of the display changing in an electronic timepiece according to a second embodiment of the invention.

When the second time correction mode is set in step S52 in the correction mode switching process S50 of the electronic timepiece according to this embodiment, the display controller 340 starts moving hand 71 and hand 21 simultaneously as shown in FIG. 21 to set the hand 71 to the second indicated position and the hand 21 to indicate the time zone of the second time.

When a previously set display time (such as 10 seconds) has passed after hand 71 is set to the second indicated position, the display controller 340 moves the 71 to indicate the DST setting at the second time.

Likewise, if the first time correction mode is set in S56, the display controller 340 starts moving hand 71 and hand 21 simultaneously to set the hand 71 to the first indicated position and the hand 21 to indicate the time zone of the first time. When a previously set display time has passed after hand 71 is set to the first indicated position, the display controller 340 moves the 71 to indicate the DST setting at the first time.

Effect of Embodiment 2

The second embodiment of the invention has the same operational effect as the configuration of the first embodiment.

In addition, when the first time correction mode or the second time correction mode is set, the time until movement of both hand 71 and hand 21 stops can be shortened compared with a configuration in which hand 71 and hand 21 do not move simultaneously.

More specifically, the time until movement of both hand 71 and hand 21 stops can be shortened because hand 71 and hand 21 start moving at the same time. Note that this movement time can also be shortened if hand 71 and hand 21 are controlled to stop moving at the same time, but this requires computing when to start moving hand 71 and hand 21, and thus complicates control.

OTHER EXAMPLES

The invention is not limited to the embodiments described above, and can be modified and improved in many ways without departing from the scope of the accompanying claims.

Figure 22:
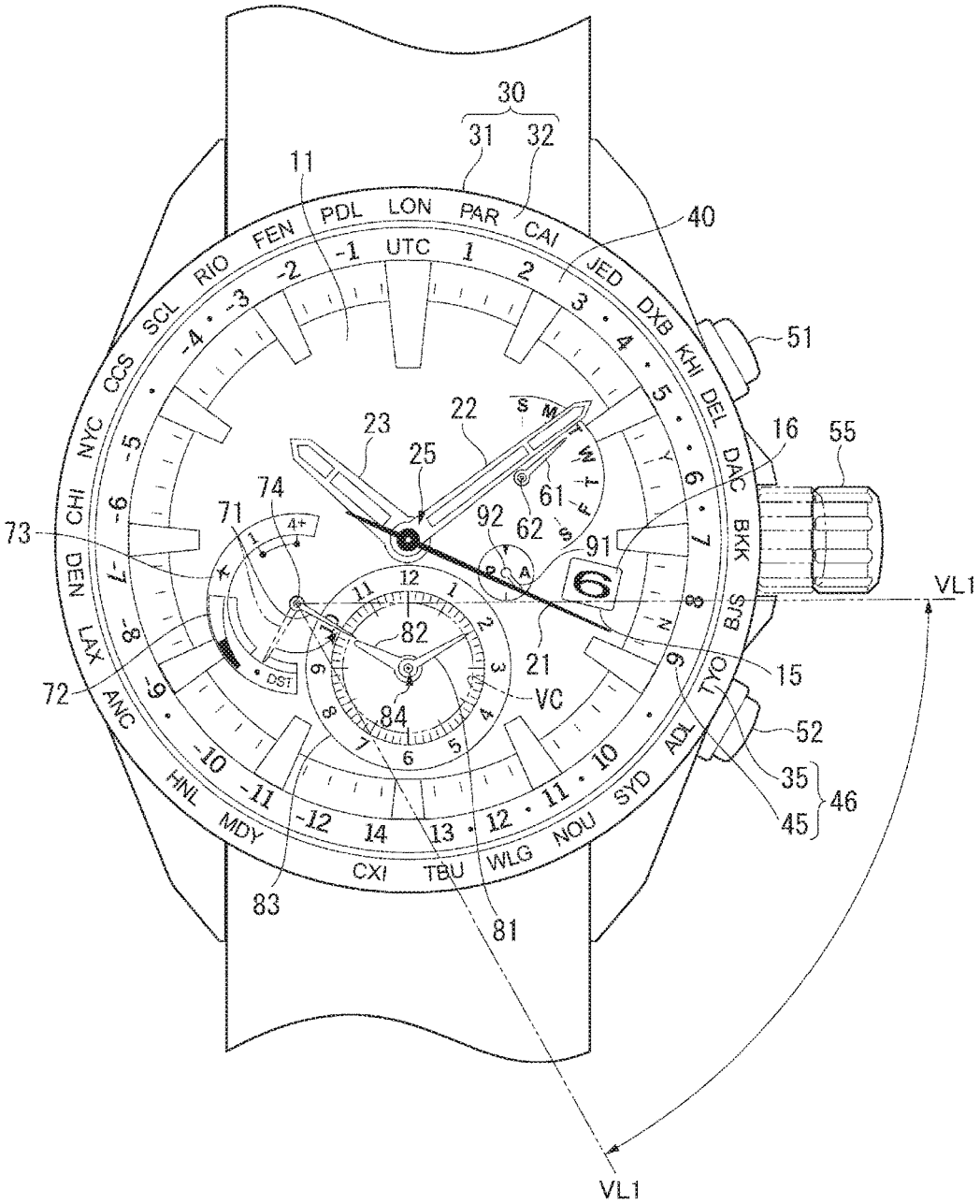
FIG. 22 illustrates an electronic timepiece according to another embodiment of the invention.

Hand 71 in the foregoing embodiments points to the location of the pivot 84 as the second indicated position, but the invention is not so limited. More specifically, hand 71 may point to any position enabling the user to know that hands 81, 82 are selected. For example, as shown in FIG. 22, the second indicated position indicated by hand 71 may be any specific position within the arc of intersection between a line VL1 extending from hand 71 and a circle VC defined by the distal end of the hand 81 (the longer of hands 81, 82). If a subdial 83 is provided as in the foregoing embodiments, hand 71 may point to a specific position in the arc of intersection between line VL1 and the outside edge of the subdial 83. These configurations also enable knowing that the hands 81, 82 are selected.

Likewise, when the first time correction mode is selected, the first indicated position of hand 71 may be any position enabling the user to know from the hand 71 that hands 22, 23 are selected.

Note that in the foregoing embodiments the pivot 74 of hand 71 is inside the circle drawn by the distal end of the first minute hand 22 (the longer of hands 22, 23), but if the pivot 74 of hand 71 is outside this circle, the first indicated position of the hand 71 may be a specific position in the arc of intersection between a line extending from the hand 71 and said circle.

The position of the pivot 84 in the direction indicated by the hand 71 is a second pivot position, and the position of the center pivot 25 in the direction indicated by the hand 71 is a first pivot position. In this case, when hand 71 is pointing to a position between the second pivot position and the first pivot position, the hand 71 points to a specific position closer to the second pivot position than the first pivot position as the second indicated position, and points to a specific position closer to the first pivot position than the second pivot position as the first indicated position.

The pivot of the hand 71 used as the indicator in the foregoing embodiments is offset toward 8:00 from the center of the dial 11, may be offset to a position other than 8:00.

A hand 71 used as a mode indicator is used as the indicator hand in the foregoing embodiments, but the hand 61 may be used in stead or another dedicated hand may be used.

Figure 23:
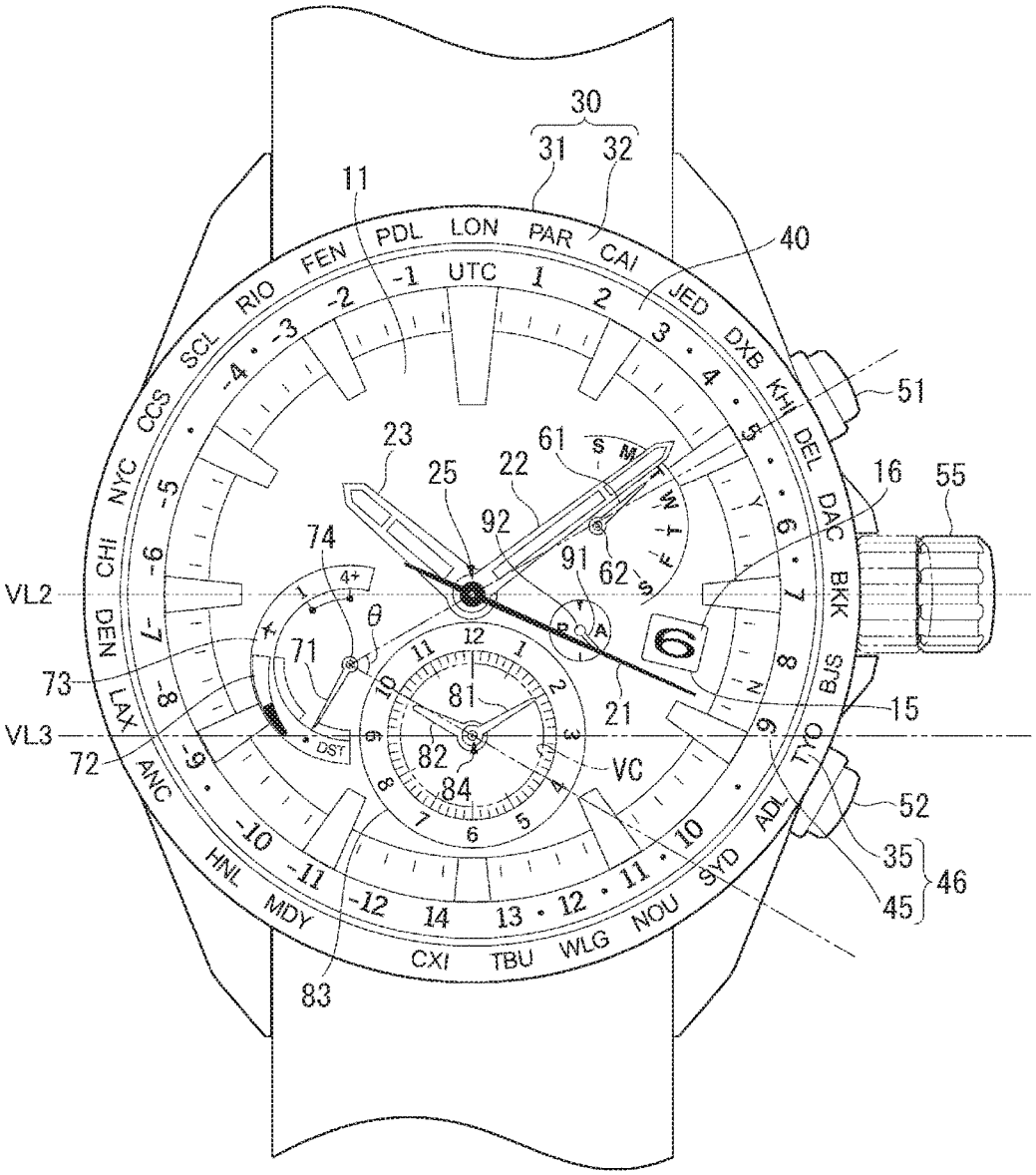
FIG. 23 illustrates an electronic timepiece according to another embodiment of the invention.

However, to facilitate knowing whether hands 22, 23 or hands 81, 82 are selected, the pivot of the indicator hand is preferably disposed similarly to the hand 71 in the foregoing embodiments, that is, to a position between the center pivot 25 and the pivot 84 in the direction between the center pivot 25 of the hands 22, 23 and the pivot 84 of the hands 81, 82. More specifically, as shown in FIG. 23, when seen in plan view, the pivot of the indicator hand is preferably located between a line VL2 passing through center pivot 25 and perpendicular to the line between the center pivot 25 and the pivot 84, and a line VL3 passing through pivot 84 and perpendicular to the line between the center pivot 25 and the pivot 84.

To further facilitate knowing whether hands 22, 23 or hands 81, 82 are selected, the angle θ between the line segment connecting the pivot of the hand and the center pivot 25, and the line segment connecting the pivot of the hand and the pivot 84, is preferably at least 30 degrees.

In the foregoing embodiments the center pivot 25 of the hands 22, 23 is in the center of the dial 11, and the pivot 84 of the hands 81, 82 is disposed offset from the dial center toward 6:00, but the invention is not so limited. More specifically, the hands 22, 23, 81, 82 may be disposed anywhere on the dial 11 as long as the center pivot 25, pivot 84, and the pivot of the hand are at different positions.

When the first time correction mode is set in response to the enable correction mode operation of the input device 160 in the foregoing embodiments, the display controller 340 indicates the DST setting with the hand 71 and does not indicate the first indicated position, but the invention is not so limited. More specifically, the display controller 340 may set the hand 71 to the first indicated position.

The foregoing embodiments set the first time correction mode in response to an enable correction mode operation of the input device 160, but the invention is not so limited. More specifically, the second time correction mode may be set.

However, because the first time, which is the local time, is expected to be adjusted more frequently than the second time, which is the home time, setting the first time correction mode in response to the enable correction mode operation offers greater ease of use than setting the second time correction mode.

In the foregoing embodiments the hand 71 points to the first indicated position or the second indicated position, and then moves to indicate the DST setting as an example of specific information, but the invention is not so limited. For example, calender information or other time-related information may be indicated instead. The first indicated position or second indicated position may also be indicated until the first time correction mode or the second time correction mode ends.

When the hand 71 is pointing to the first indicated position or the second indicated position in the foregoing embodiments and the input device 160 is then operated, the hand 71 may move to indicate the DST setting or other specific information. As a result, after the hand 71 points to the first indicated position or second indicated position, the user can manipulate the input device 160 and read the information indicated by the moved hand 71 to acquire specific information.

The first time or the second time is corrected by the time zone correction operation in the foregoing embodiments, but the invention is not so limited. For example, the crown 55 may be turned to manually set the time indicated by the hands 22, 23 or hands 81, 82 to the time in a desired location.

When the first time correction mode or the second time correction mode is set in the foregoing embodiments, the second hand 21 indicates the time zone setting, but the invention is not so limited. More specifically, the second hand 21 may continue indicating the second of the first time and second time.

A different hand than the second hand 21 may also be used to indicate time zone data.

The hands 22, 23 and hands 81, 82 continue moving when the first time correction mode or the second time correction mode is set in the foregoing embodiments, but the invention is not so limited. More specifically, the hands may be stopped.

The hands 21, 22, 23, 61, 71, 81, 82, 91 in the foregoing embodiments may also be images that are displayed by a display unit such as an LCD panel. However, because the hands 21, 22 or hands 81, 82 that are selected for adjusting can be made to blink in this case, using indicator hands is more useful when the indicator hands are physical members as in the embodiments described above.

The hand 71 used as an indicator hand may further alternatively be a hand symbol that is printed on a disk.

The embodiments described above have two sets of hour and minute hands, but the invention is not so limited. More specifically, more than one set of hour and minute hands maybe added. In this case, when the time correction mode is selected for a particular pair of hour and minute hands, an indicator hand points to an indicated position identifying the hour and minute hands to be adjusted.

In the embodiments described above, the corresponding daylight saving time setting is not indicated by the hand 71 when the time zone is changed, but the invention is not so limited. More specifically, DST settings and time zone data maybe relationally stored in memory, and when the time zone is changed, the corresponding DST setting may be indicated by the hand 71.

In the foregoing embodiments the first time zone data 216 and second time zone data 217 are stored only in EEPROM 202, but the invention is not so limited.

For example, the first time zone data 216 and second time zone data 217 may also be stored in RAM 201 instead of only in EEPROM 202.

In this case, the time zone data is stored in RAM 201 while the time zone is being corrected, the time zone data is then written to EEPROM 202 after the setting the time zone is completed, and EEPROM 202 access can therefore be minimized.

The foregoing embodiments are described with reference to a GPS satellite 100 as an example of a positioning information satellite, but the positioning information satellite of the invention is not limited to GPS satellites and the invention can be used with Global Navigation Satellite Systems (GNSS) such as Galileo (EU), GLONASS (Russia), and Beidou (China). The invention can also be used with geostationary satellites in satellite-based augmentation systems (SBAS), and quasi-zenith satellites in radio navigation satellite systems (RNSS) that can only search in specific regions. The invention can also be used in configurations that receive and process satellite signals from multiple systems.

The invention can also be used in an electronic timepiece that does not receive satellite signals. The invention is also not limited to electronic timepieces, and can be used in a broad range of electronics devices with a time display function, including wearables worn on the wrist and cell phones.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2016-057312, filed Mar. 22, 2016 is expressly incorporated by reference herein.

What is claimed is:

1. An electronic device comprising:

first hands including a first hour hand and a first minute hand configured to display a first time;

second hands including a second hour hand and a second minute hand configured to display a second time, and disposed to a pivot at a different location than the pivot of the first hands;

an indicator hand on a pivot at a different location than the pivots of the first hands and the second hands;

an operating unit;

a correction mode setting unit that sets a first time correction mode for adjusting the first time, or a second time correction mode for adjusting the second time, in response to a correction mode setting operation; and a display control unit configured to move the indicator hand to the first indicated position indicating that the hands to be corrected are the first hands when the first time correction mode is set, and move the indicator hand to the second indicated position indicating that the hands to be corrected are the second hands when the second time correction mode is set.

2. The electronic device described in claim 1, wherein:

as the first indicated position, the display control unit points the indicator hand to the position of the pivot of the first hands in the direction indicated by the indicator hand, as the second indicated position, points the indicator hand to the position of the pivot of the second hands in the direction indicated by the indicator hand.

3. The electronic device described in claim 1, wherein:

the pivot of the indicator hand is located outside of a circle drawn by the distal end of at least one of the first hands and the second hands; and the display control unit, as the indicated position indicating the hands to be corrected are one of the first hands or second hands, points the indicator hand to a specific position within the arc of intersection between said circle and a line extending in the indication direction of the indicator hand.

4. The electronic device described in claim 1, wherein:

if a previously set display time has passed after pointing the indicator hand to the first indicated position or the second indicated position, the display control unit points the indicator hand to a position other than the first indicated position or second indicated position to indicate specific information.

5. The electronic device described in claim 4, wherein:

the specific information is a daylight saving time setting.

6. The electronic device described in claim 1, wherein:

when the indicator hand is set to the first indicated position or the second indicated position, the display control unit points the indicator hand to a position other than the first indicated position or second indicated position to indicate specific information in response to operation of the operating unit.

7. The electronic device described in claim 1, further comprising:

a time zone setting unit configured to, when the first time correction mode is set, correct the time zone setting of the first time in response to a time zone correction operation of the operating unit, and when the second time correction mode is set, correct the time zone setting of the second time in response to a time zone correction operation of the operating unit; and a time correction unit configured to correct the first time based on the corrected time zone setting of the first time, and correct the second time based on the corrected time zone setting of the second time.

8. The electronic device described in claim 7, further comprising:

a time zone hand that displays time zone data;

the display control unit pointing the time zone hand to indicate the time zone of the first time when the first time correction mode is set, and pointing the time zone hand to indicate the time zone of the second time when the second time correction mode is set.

9. The electronic device described in claim 8, wherein:

the display control unit preferably moves the indicator hand and the time zone hand simultaneously when the first time correction mode or the second time correction mode is set and the indicator hand and the time zone hand are moved.

10. The electronic device described in claim 8, wherein:

when moving the indicator hand and the time zone hand when the first time correction mode or the second time correction mode is set, the display control unit moves the indicator hand, then moves the time zone hand after moving the indicator hand, and after moving the time zone hand, points the indicator hand to a position other than the first indicated position and second indicated position to display specific information.

11. The electronic device described in claim 8, further comprising:

a dial;

the pivots of the first hands and the time zone hand being in the plane center of the dial.

12. The electronic device described in claim 1, wherein:

the display control unit continuously moves the first hour hand, the first minute hand, the second hour hand, and the second minute hand when the first time correction mode or the second time correction mode is set.

13. An electronic device comprising:

first hands including a first hour hand and a first minute hand configured to display a first time;

second hands including a second hour hand and a second minute hand configured to display a second time, and disposed to a pivot at a different location than the pivot of the first hands;

an indicator hand disposed to a pivot at a different location than the pivots of the first hands and the second hands;

an operating unit;

a correction mode setting unit configured to set a first time correction mode for adjusting the first time in response to an enable correction mode operation of the operating unit causing entering a time correction mode, or switch to the first time correction mode or a second time correction mode for correcting the second time in response to a change correction mode operation of the operating unit causing changing the type of the time correction mode; and a display control unit configured to, when the first time correction mode is set in response to the enable correction mode operation, not point the indicator hand to the first indicated position, which indicates the hands to be corrected are the first hands, when the first time correction mode is set in response to the change correction mode operation, point the indicator hand to the first indicated position, and when the second time correction mode is set, point the indicator hand to a second indicated position, which indicates the hands to be corrected are the second hands.

14. The electronic device described in claim 13, wherein:

as the first indicated position, the display control unit points the indicator hand to the position of the pivot of the first hands in the direction indicated by the indicator hand, as the second indicated position, points the indicator hand to the position of the pivot of the second hands in the direction indicated by the indicator hand.

15. The electronic device described in claim 13, wherein:

the pivot of the indicator hand is located outside of a circle drawn by the distal end of at least one of the first hands and the second hands; and the display control unit, as the indicated position indicating the hands to be corrected are one of the first hands or second hands, points the indicator hand to a specific position within the arc of intersection between said circle and a line extending in the indication direction of the indicator hand.

16. The electronic device described in claim 13, wherein:

if a previously set display time has passed after pointing the indicator hand to the first indicated position or the second indicated position, the display control unit points the indicator hand to a position other than the first indicated position or second indicated position to indicate specific information.

17. The electronic device described in claim 16, wherein:

the specific information is a daylight saving time setting.

18. The electronic device described in claim 13, wherein:

when the indicator hand is set to the first indicated position or the second indicated position, the display control unit points the indicator hand to a position other than the first indicated position or second indicated position to indicate specific information in response to operation of the operating unit.

19. The electronic device described in claim 13, further comprising:

a time zone setting unit configured to, when the first time correction mode is set, correct the time zone setting of the first time in response to a time zone correction operation of the operating unit, and when the second time correction mode is set, correct the time zone setting of the second time in response to a time zone correction operation of the operating unit; and a time correction unit configured to correct the first time based on the corrected time zone setting of the first time, and correct the second time based on the corrected time zone setting of the second time.

20. The electronic device described in claim 19, further comprising:

a time zone hand that displays time zone data;

the display control unit pointing the time zone hand to indicate the time zone of the first time when the first time correction mode is set, and pointing the time zone hand to indicate the time zone of the second time when the second time correction mode is set.

21. The electronic device described in claim 20, wherein:

the display control unit preferably moves the indicator hand and the time zone hand simultaneously when the first time correction mode or the second time correction mode is set and the indicator hand and the time zone hand are moved.

22. The electronic device described in claim 20, wherein:

when moving the indicator hand and the time zone hand when the first time correction mode or the second time correction mode is set, the display control unit moves the indicator hand, then moves the time zone hand after moving the indicator hand, and after moving the time zone hand, points the indicator hand to a position other than the first indicated position and second indicated position to display specific information.

23. The electronic device described in claim 20, further comprising:

a dial;

the pivots of the first hands and the time zone hand being in the plane center of the dial.

24. The electronic device described in claim 13, wherein:

the display control unit continuously moves the first hour hand, the first minute hand, the second hour hand, and the second minute hand when the first time correction mode or the second time correction mode is set.

* * * * *